US010899538B2

(12) United States Patent
Nelson et al.

(10) Patent No.: US 10,899,538 B2
(45) Date of Patent: Jan. 26, 2021

(54) GRABBER FOR A REFUSE VEHICLE

(71) Applicant: Oshkosh Corporation, Oshkosh, WI (US)

(72) Inventors: Joseph Nelson, Oshkosh, WI (US); John Kuphal, Oshkosh, WI (US); Jeffrey Gerhart, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

(21) Appl. No.: 16/590,155

(22) Filed: Oct. 1, 2019

(65) Prior Publication Data

US 2020/0102145 A1 Apr. 2, 2020

Related U.S. Application Data

(60) Provisional application No. 62/740,253, filed on Oct. 2, 2018, provisional application No. 62/743,280, filed on Oct. 9, 2018.

(51) Int. Cl.
*B65F 3/02* (2006.01)

(52) U.S. Cl.
CPC ..... *B65F 3/02* (2013.01); *B65F 2003/023* (2013.01); *B65F 2003/0226* (2013.01)

(58) Field of Classification Search
CPC ..... B65F 3/02; B25J 13/082; B65B 23/02
USPC ..... 294/198, 106; 414/408
See application file for complete search history.

(56) References Cited

U.S. PATENT DOCUMENTS 4,315,652 A * 2/1982 Barwise ..... B66C 3/16 294/112
4,461,608 A * 7/1984 Boda ..... B65F 3/041 294/106
5,026,104 A * 6/1991 Pickrell ..... B65F 3/046 294/106
5,092,731 A * 3/1992 Jones ..... B65F 3/08 294/106
5,209,537 A * 5/1993 Smith ..... B65F 1/0046 294/106
5,330,242 A * 7/1994 Lucky, Sr. ..... B66C 3/04 294/106
5,919,027 A 7/1999 Christenson
5,934,858 A 8/1999 Christenson
5,934,867 A 8/1999 Christenson
5,938,394 A 8/1999 Christenson
5,951,235 A 9/1999 Young et al.
(Continued)

FOREIGN PATENT DOCUMENTS

WO WO-01/30671 5/2001

*Primary Examiner* — Paul T Chin
(74) *Attorney, Agent, or Firm* — Foley & Lardner LLP

(57) ABSTRACT

A grabber assembly includes a carriage, an adapter assembly, and a grabber arm. The adapter assembly is coupled to the carriage and includes a pin, a first member, a second member, and a sleeve. The first member is configured to receive a first end of the pin and removably fixedly couple with the first end of the pin. The second member is configured to receive a second end of the pin and removably fixedly couple with the second end of the pin. The sleeve extends co-cylindrically with the pin. The grabber arm includes a bushing. The bushing is fixedly coupled with the grabber arm and is pivotally coupled to the pin. The sleeve is positioned within a central bore of the bushing, between the bushing and the pin.

20 Claims, 27 Drawing Sheets

(56) References Cited

U.S. PATENT DOCUMENTS 5,967,731 A 10/1999 Brandt
5,984,609 A 11/1999 Bartlett
6,033,176 A 3/2000 Bartlett
6,062,803 A 5/2000 Christenson
6,089,813 A 7/2000 McNeilus et al.
6,120,235 A 9/2000 Humphries et al.
6,123,500 A 9/2000 McNeilus et al.
6,210,094 B1 4/2001 McNeilus et al.
6,213,706 B1 4/2001 Christenson
6,224,318 B1 5/2001 McNeilus et al.
6,315,515 B1 11/2001 Young et al.
6,336,783 B1 1/2002 Young et al.
6,350,098 B1 2/2002 Christenson et al.
6,447,239 B2 9/2002 Young et al.
6,474,928 B1 11/2002 Christenson
6,565,305 B2 5/2003 Schrafel
7,070,382 B2 7/2006 Pruteanu et al.
7,207,610 B1 * 4/2007 Kauppila ..... B66C 1/585 294/106
7,284,943 B2 10/2007 Pruteanu et al.
7,556,468 B2 7/2009 Grata
7,559,735 B2 7/2009 Pruteanu et al.
7,878,750 B2 2/2011 Zhou et al.
8,182,194 B2 5/2012 Pruteanu et al.
8,215,892 B2 7/2012 Calliari
8,360,706 B2 1/2013 Addleman et al.
8,540,475 B2 9/2013 Kuriakose et al.
8,807,613 B2 8/2014 Howell et al.
8,833,823 B2 * 9/2014 Price ..... B66C 1/44 294/198
9,028,193 B2 5/2015 Goedken
9,216,856 B2 12/2015 Howell et al.
9,387,985 B2 7/2016 Gillmore et al.
9,624,033 B1 4/2017 Price et al.
9,694,776 B2 7/2017 Nelson et al.
9,880,581 B2 1/2018 Kuriakose et al.
9,981,803 B2 5/2018 Davis et al.
10,035,648 B2 7/2018 Haddick et al.
10,196,205 B2 2/2019 Betz et al.
10,221,012 B2 * 3/2019 Hund, Jr. ..... B65F 3/04
10,457,533 B2 10/2019 Puszkiewicz et al.
2005/0140154 A1 * 6/2005 Vigholm ..... B66C 3/04 294/198
2013/0057007 A1 * 3/2013 Howell ..... B65F 3/04 294/198
2014/0312639 A1 * 10/2014 Petronek ..... B66F 9/183 294/198
2016/0121490 A1 * 5/2016 Ottersland ..... E21B 19/155 294/198

* cited by examiner

GRABBER FOR A REFUSE VEHICLE

CROSS-REFERENCE TO RELATED PATENT APPLICATION

This application claims the benefit of and priority to U.S. Provisional Patent Application No. 62/743,280, filed Oct. 9, 2018, and U.S. Provisional Patent Application No. 62/740,253, filed Oct. 2, 2018, the entire disclosures of which are incorporated by reference herein.

BACKGROUND

The present invention generally relates to the field of refuse vehicles, and in particular, to a grabber assembly for a refuse vehicle.

SUMMARY

One implementation of the present disclosure is a grabber assembly, according to an exemplary embodiment. The grabber assembly includes a carriage, an adapter assembly, and a grabber arm. The adapter assembly is coupled to the carriage and includes a pin, a first member, a second member, and a sleeve. The first member is configured to receive a first end of the pin and removably fixedly couple with the first end of the pin. The second member is configured to receive a second end of the pin and removably fixedly couple with the second end of the pin. The sleeve extends co-cylindrically with the pin. The grabber arm includes a bushing. The bushing is fixedly coupled with the grabber arm and is pivotally coupled to the pin. The sleeve is positioned within a central bore of the bushing, between the bushing and the pin.

Another implementation of the present disclosure is a grabber assembly, according to an exemplary embodiment. The grabber assembly includes a carriage, an adapter assembly, and a grabber arm. The adapter assembly is coupled to the carriage and includes a sleeve, a pin, a first member, and a second member. The pin extends through the sleeve. The pin includes a longitudinal passage way, one or more radially extending passageways, and a gap. The one or more radially extending passageways fluidly couple with the longitudinal passageway and the gap. The gap is defined between a radially inwards facing surface of the sleeve and a radially outwards facing surface of the pin. The first member is configured to receive a first end of the pin and pivotally couple with the first end of the pin. The second member is configured to receive a second end of the pin and pivotally couple with the second end of the pin. The grabber arm includes a bushing. The bushing is fixedly coupled with the grabber arm. The bushing is configured to pivotally couple with the pin.

Another implementation of the present disclosure is a grabber assembly including a carriage, a grabber arm, a double-action cylinder, and a mount assembly. The grabber arm is pivotally coupled with the carriage. The double-action cylinder is configured to extend and retract to pivot the grabber arm relative to the carriage. The double-action cylinder is configured to pivotally couple with the grabber arm at a first end of the double-action cylinder and pivotally couple with the carriage at a second end of the double-action cylinder through the mount assembly. The mount assembly includes a first mounting member, a cylindrical member, a first bushing, and a second bushing. The first mounting member and the second mounting member are fixedly and removably coupled with the carriage. The cylindrical member extends between the first mounting member and the second mounting member. The cylindrical member extends through a corresponding aperture of the second end of the double-action cylinder. The first bushing is positioned within a bore of the first mounting member. The second bushing is positioned within a bore of the second mounting member. The cylindrical member extends through a central aperture of the first bushing and the second bushing. The cylindrical member is fixedly coupled with at least one of the first mounting member and the second mounting member through a connection member.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the FIGURES, which illustrate the exemplary embodiments in detail, it should be understood that the present application is not limited to the details or methodology set forth in the description or illustrated in the FIGURES. It should also be understood that the terminology is for the purpose of description only and should not be regarded as limiting.

Overview

Referring generally to the FIGURES, a refuse truck is shown, including a lift mechanism, according to an exemplary embodiment. The lift mechanism is shown to include a track, a connecting portion connected to the track and configured to move along an entire path length of the track, and a grabber assembly removably connected to the connecting portion. The grabber assembly is shown to include a first adapter assembly and a second adapter assembly, removably connected at opposing ends of a mast of the grabber assembly. The grabber assembly is also shown to include a first grabber arm and a second grabber arm rotatably coupled to the first adapter assembly and the second adapter assembly, respectively, such that the first grabber arm is configured to pivot about the first adapter assembly, and the second grabber arm is configured to pivot about the second adapter assembly. The first adapter assembly and the second adapter assembly are shown to be removably connected to the mast of the grabber assembly with removable fasteners. In some embodiments, any contact surfaces of the first adapter assembly, the second adapter assembly, the first grabber arm, and the second grabber arm are lubricated using a greaseless lubrication such as a polymeric material. The first adapter assembly and second adapter assembly are each shown to include a top adapter, a bottom adapter, and an adapter pin extending between a distance of the top adapter and the bottom adapter therein. In some embodiments, the adapter pin is removably connected at opposing ends to the top adapter and the bottom adapter with removable fasteners. The adapter pin is configured to interface with a grabber arm connection (e.g., a bushing) of one of the grabber arms, such that the grabber arm is supported by the adapter assembly and is allowed to rotate about the adapter pin. The adapter pin extends through the grabber arm connection (e.g., bushing) of the grabber arm. Each of the first grabber arm and the second grabber arm may be configured to pivot about the adapter pin of the first adapter assembly and the adapter pin of the second adapter assembly, such that the first grabber arm and the second grabber arm grasp a refuse container. The refuse container may then be lifted off the ground by the lift mechanism, transported along the track, and emptied into a refuse compartment of the refuse vehicle. The refuse container may then be transported back along the track, set on the ground, and released from the grabber assembly by pivoting each of the grabber arms.

Refuse Vehicle

Figure 1:
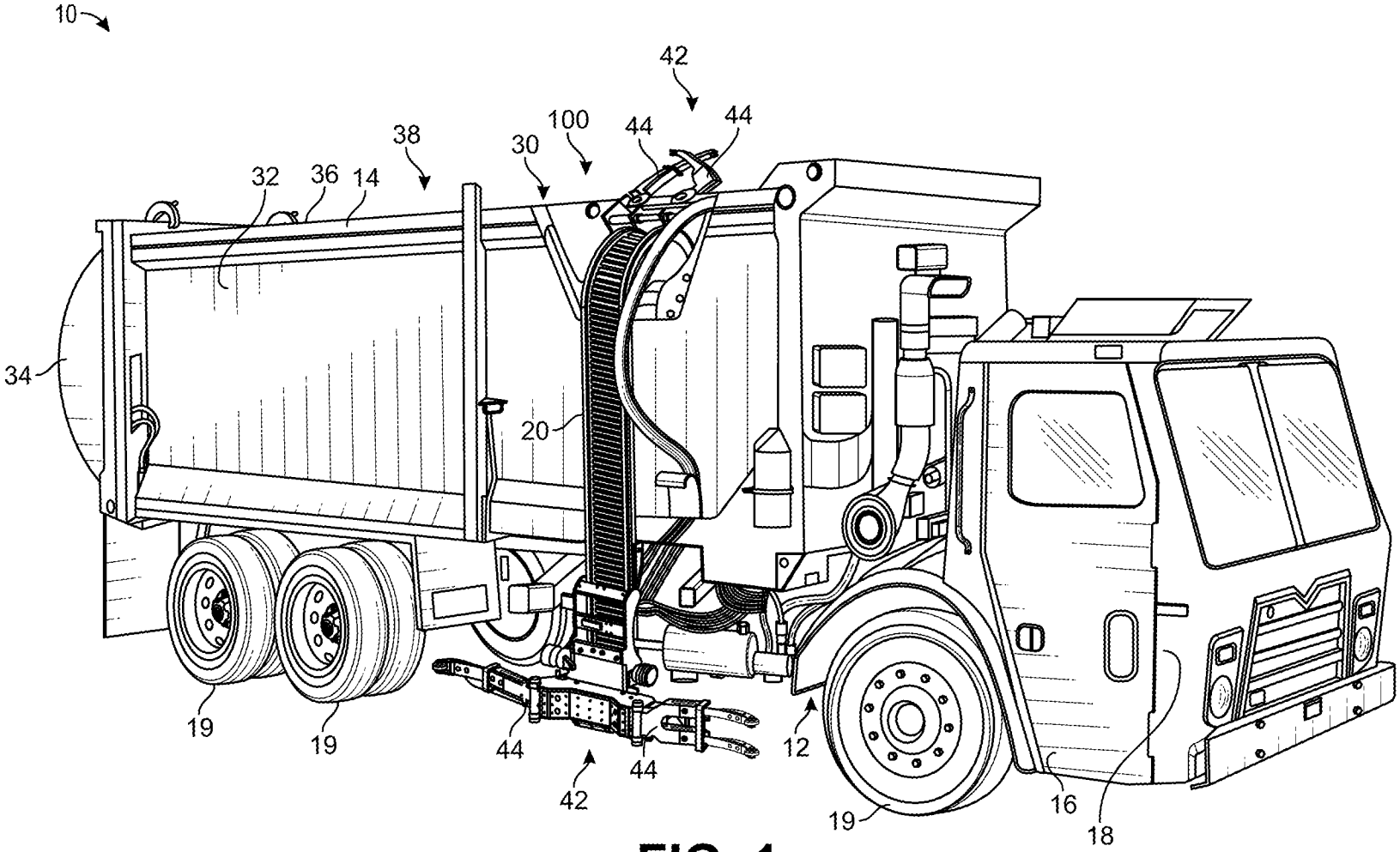
FIG. 1 is a perspective view of a refuse vehicle, shown to include a loading assembly, a track, and a grabber assembly, according to an exemplary embodiment.

According to the exemplary embodiment shown in FIG. 1, a vehicle, shown as refuse vehicle 10 (e.g., a garbage truck, a waste collection truck, a sanitation truck, etc.), is configured as a side-loading refuse truck having a first lift mechanism/system (e.g., a side-loading lift assembly, etc.), shown as lift assembly 100. In other embodiments, refuse vehicle 10 is configured as a front-loading refuse truck or a rear-loading refuse truck. In still other embodiments, the vehicle is another type of vehicle (e.g., a skid-loader, a telehandler, a plow truck, a boom lift, etc.). As shown in FIG. 1, refuse vehicle 10 includes a chassis, shown as frame 12; a body assembly, shown as body 14, coupled to frame 12 (e.g., at a rear end thereof, etc.); and a cab, shown as cab 16, coupled to frame 12 (e.g., at a front end thereof, etc.). Cab 16 may include various components to facilitate operation of refuse vehicle 10 by an operator (e.g., a seat, a steering wheel, hydraulic controls, a user interface, switches, buttons, dials, etc.). As shown in FIG. 1, refuse vehicle 10 includes a prime mover, shown as engine 18, coupled to frame 12 at a position beneath cab 16. Engine 18 is configured to provide power to a plurality of tractive elements, shown as wheels 19, and/or to other systems of refuse vehicle 10 (e.g., a pneumatic system, a hydraulic system, etc.). Engine 18 may be configured to utilize one or more of a variety of fuels (e.g., gasoline, diesel, bio-diesel, ethanol, natural gas, etc.), according to various exemplary embodiments. According to an alternative embodiment, engine 18 additionally or alternatively includes one or more electric motors coupled to frame 12 (e.g., a hybrid refuse vehicle, an electric refuse vehicle, etc.). The electric motors may consume electrical power from an on-board storage device (e.g., batteries, ultra-capacitors, etc.), from an on-board generator (e.g., an internal combustion engine, etc.), and/or from an external power source (e.g., overhead power lines, etc.) and provide power to the systems of refuse vehicle 10.

According to an exemplary embodiment, refuse vehicle 10 is configured to transport refuse from various waste receptacles within a municipality to a storage and/or processing facility (e.g., a landfill, an incineration facility, a recycling facility, etc.). As shown in FIG. 1, body 14 includes a plurality of panels, shown as panels 32, a tailgate 34, and a cover 36. Panels 32, tailgate 34, and cover 36 define a collection chamber (e.g., hopper, etc.), shown as refuse compartment 30. Loose refuse may be placed into refuse compartment 30 where it may thereafter be compacted. Refuse compartment 30 may provide temporary storage for refuse during transport to a waste disposal site and/or a recycling facility. In some embodiments, at least a portion of body 14 and refuse compartment 30 extend in front of cab 16. According to the embodiment shown in FIG. 1, body 14 and refuse compartment 30 are positioned behind cab 16. In some embodiments, refuse compartment 30 includes a hopper volume and a storage volume. Refuse may be initially loaded into the hopper volume and thereafter compacted into the storage volume. According to an exemplary embodiment, the hopper volume is positioned between the storage volume and cab 16 (i.e., refuse is loaded into a position of refuse compartment 30 behind cab 16 and stored in a position further toward the rear of refuse compartment 30). In other embodiments, the storage volume is positioned between the hopper volume and cab 16 (e.g., a rear-loading refuse vehicle, etc.).

As shown in FIG. 1, refuse vehicle 10 includes first lift mechanism/system (e.g., a front-loading lift assembly, etc.), shown as lift assembly 100. Lift assembly 100 includes a grabber assembly, shown as grabber assembly 42, movably coupled to a track, shown as track 20, and configured to move along an entire length of track 20. According to the exemplary embodiment shown in FIG. 1, track 20 extends along substantially an entire height of body 14 and is configured to cause grabber assembly 42 to tilt near an upper height of body 14. In other embodiments, track 20 extends along substantially an entire height of body 14 on a rear side of body 14.

Figure 3:
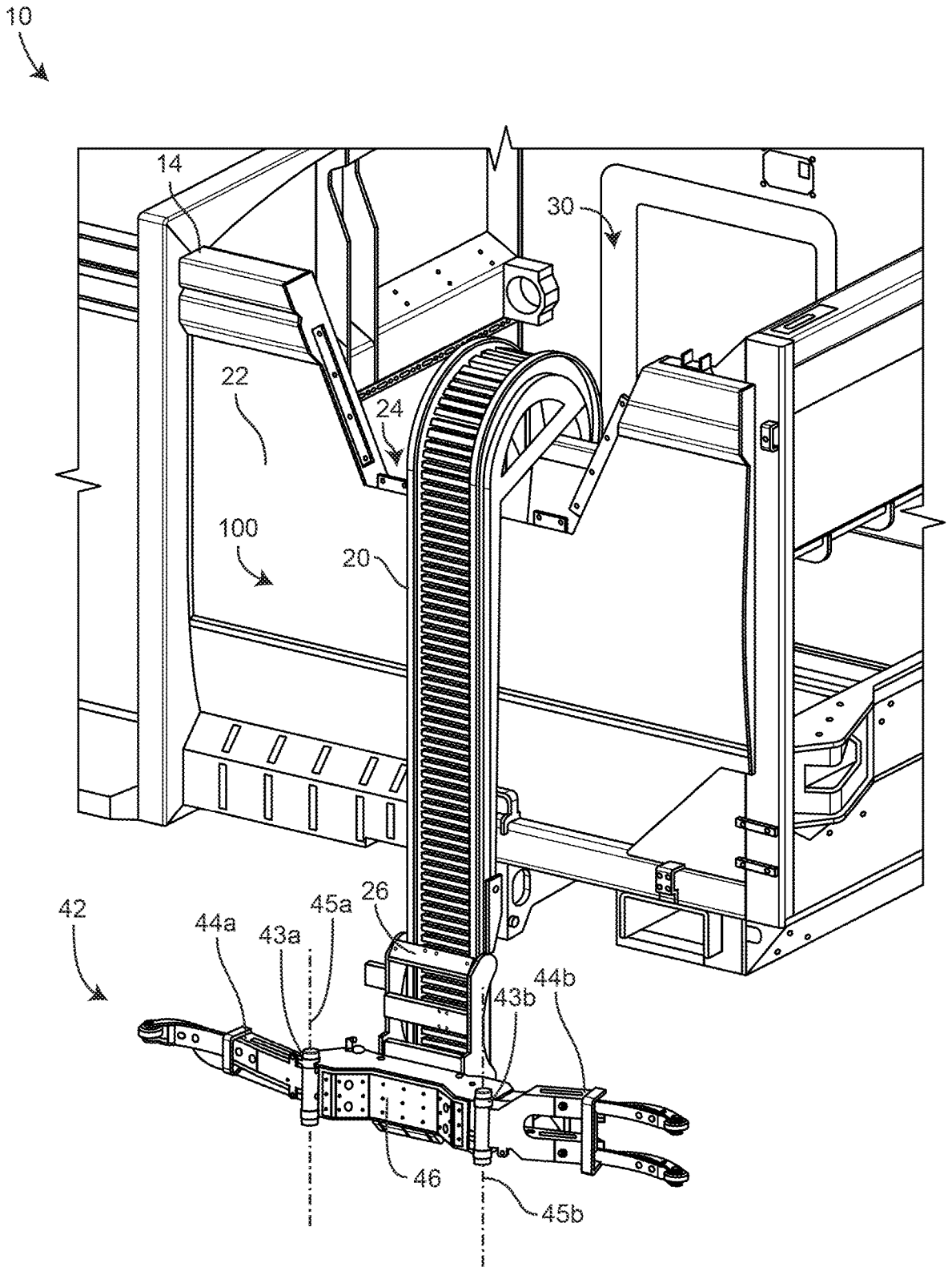
FIG. 3 is a perspective view of the loading assembly of the refuse vehicle of FIG. 1, shown to include the grabber assembly of FIG. 1, according to an exemplary embodiment.

Referring still to FIG. 1, grabber assembly 42 includes a pair of grabber arms shown as grabber arms 44. Grabber arms 44 are configured to rotate about an axis extending through a bushing. Grabber arms 44 are configured to releasably secure a refuse container to grabber assembly 42, according to an exemplary embodiment. Grabber arms 44 rotate about the axis extending through the bushing to transition between an engaged state and a disengaged state. When transitioning into the engaged state, grabber arms 44 are rotated towards each other such that the refuse container is grasped therein. When transitioning into the disengaged state, grabber arms 44 rotate outwards (as shown in FIG. 3) such that the refuse container is not grasped therein or is released. By transitioning between the engaged state and the disengaged state, grabber assembly 42 releasably and selectably couples the refuse container to grabber assembly 42. Refuse vehicle 10 may pull up along-side the refuse container, such that the refuse container is positioned to be grasped by grabber assembly 42. Grabber assembly 42 may then transition into the engaged state to grasp the refuse container. After the refuse container has been securely grasped, grabber assembly 42 may be transported along track 20 with the refuse container. When grabber assembly 42 reaches the end of track 20, grabber assembly 42 may tilt and empty the contents of the refuse container in refuse compartment 30. The tilting can be facilitated by the path of track 20. When the contents of the refuse container have been emptied into refuse compartment 30, grabber assembly 42 may descend along track 20, and return the refuse container to the ground. Once the refuse container has been placed on the ground, grabber assembly 42 may transition into the disengaged state, releasing the refuse container.

Lift Assembly

Figure 2:
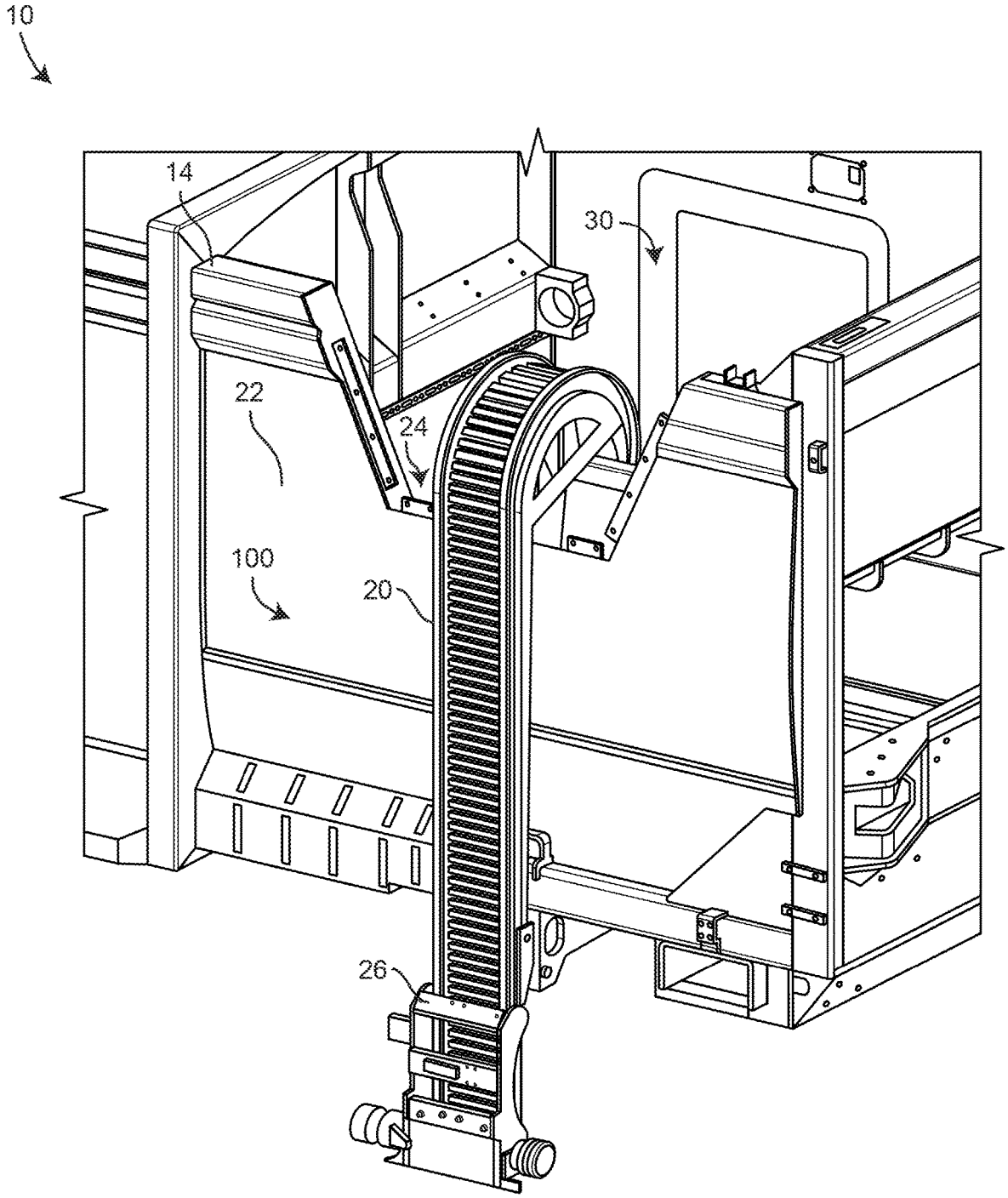
FIG. 2 is a perspective view of the loading assembly of the refuse vehicle of FIG. 1, according to an exemplary embodiment.

Referring now to FIGS. 2-3, lift assembly 100 is shown in greater detail, according to an exemplary embodiment. Lift assembly 100 is shown to include track 20, and a connecting member, shown as connecting member 26. Track 20 is configured to extend along substantially an entire height of body 14, according to the exemplary embodiment shown. Body 14 is shown to include a loading section, shown as loading section 22. Loading section 22 is shown to include a recessed portion, shown as recessed portion 24. Recessed portion 24 is configured such that track 20 curves through recessed portion 24, thereby facilitating emptying (e.g., into refuse compartment 30) of a refuse bin (e.g., a garbage can) releasably coupled with grabber assembly 42.

Still referring to FIGS. 2-3, connecting member 26 is shown translationally coupled with track 20. Connecting member 26 is coupled with track 20 (e.g., through rollers, slidable bearings, etc.) such that connecting member 26 may move along an entire path length of track 20. Connecting member 26 may removably and fixedly couple with grabber assembly 42, thereby removably and movably coupling grabber assembly 42 with track 20, and facilitating transportation of grabber assembly 42 along the entire path length of track 20. Connecting member 26 removably couples (e.g., by removable fasteners) to a carriage portion of grabber assembly 42, shown as carriage 46. Carriage 46 may be a frame, a mast, a structural member, a main member, a support member, etc. Grabber assembly 42 is shown to include grabber arms, grasping members, elongated members, etc., shown as first grabber arm 44*a* and second grabber arm 44*b*, according to an exemplary embodiment. First grabber arm 44*a* and second grabber arm 44*b* are each configured to pivot about 45*a* and axis 45*b*, respectively. Axis 45*a* is defined as an axis longitudinally extending through a first adapter assembly (e.g., a bushing), shown as first adapter assembly 43*a*, and axis 45*b* is defined as an axis longitudinally extending through a second adapter assembly (e.g., a bushing), shown as second adapter assembly 43*a*. First adapter assembly 43*a* fixedly couples with a first end of carriage 46, and rotatably couples with first grabber arm 44*a*. Second adapter assembly 43*b* fixedly couples with a second end of carriage 46, and rotatably couples with second grabber arm 44*b*. First adapter assembly 43*a* and second adapter assembly 43*b* pivotally or rotatably couple first grabber arm 44*a* and second grabber arm 44*b* with carriage 46, and facilitate rotation of first grabber arm 44*a* and second grabber arm 44b about axis 45*a* and axis 45*b*, respectively.

Figure 4A:
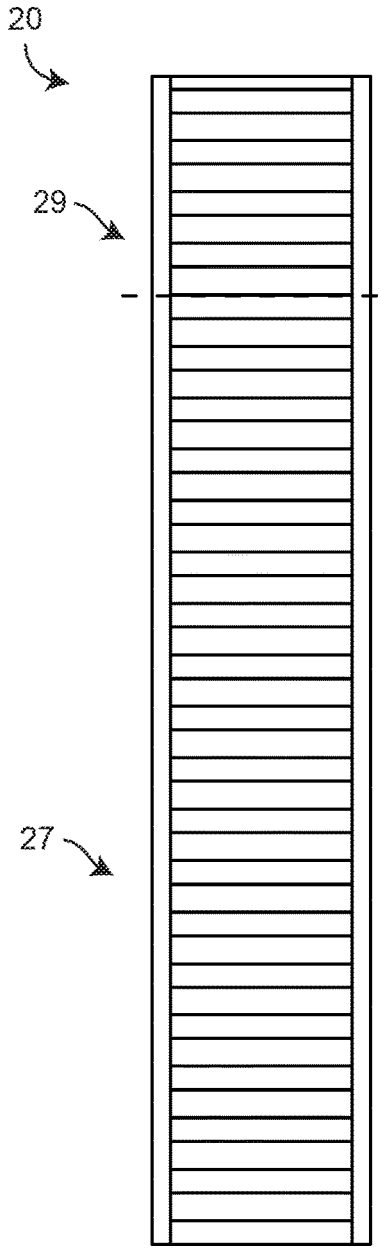
FIG. 4A is a front view of the track of FIG. 1, according to an exemplary embodiment.
Figure 4B:
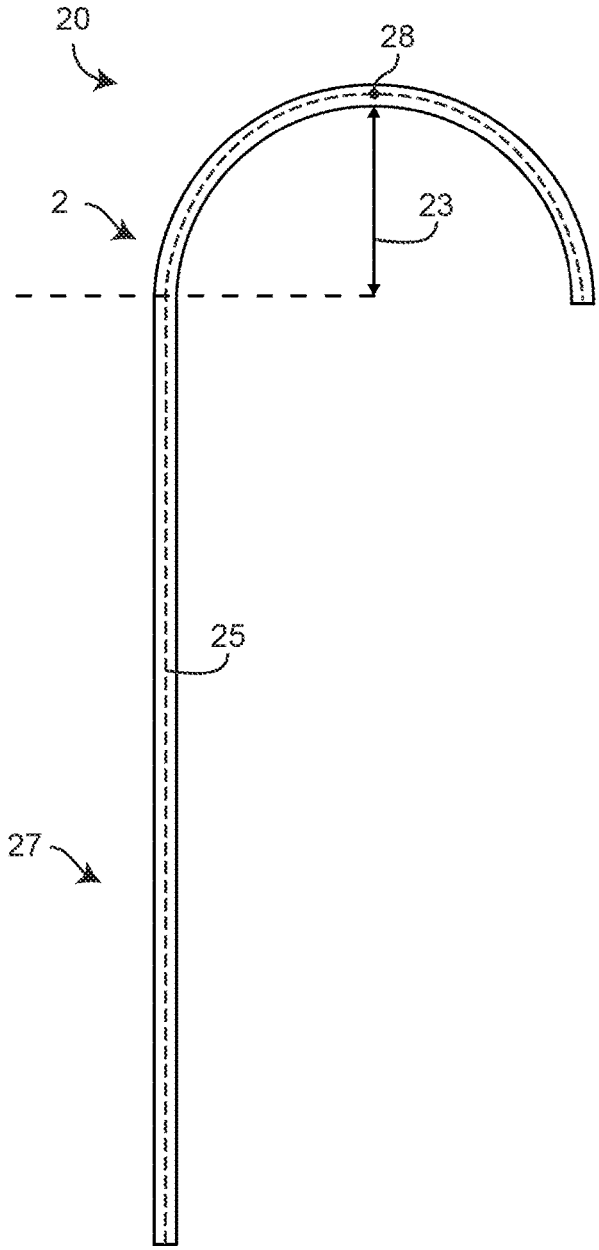
FIG. 4B is a side view of the track of FIG. 1, according to an exemplary embodiment.

Referring now to FIGS. 4A-4B, track 20 is shown in greater detail according to an exemplary embodiment. FIG. 4A shows a front view of track 20, and FIG. 4B shows a side view of track 20, according to an exemplary embodiment. Track 20 is shown to include a straight portion 27, and a curved portion 29. Straight portion 27 may be substantially vertical, and/or substantially parallel to loading section 22 of body 14. Curved portion 29 may have a radius of curvature, shown as radius 23. In some embodiments, curved portion 29 has a constant radius of curvature (i.e., curved portion 29 has a constant radius 23 along all points on a path of curved portion 29), while in other embodiments, curved portion 29 has a non-constant radius of curvature (i.e., curved portion 29 has a non-constant radius 23 along various points on the path of curved portion 29). According to an exemplary embodiment, straight portion 27 has an infinite radius of curvature. Grabber assembly 42 may travel along a path of track 20, shown as path 25. Track 20 may be configured to tilt grabber assembly 42 to empty contents of a refuse container when grabber assembly 42 travels along path 25 and travels past a point on path 25, shown as point 28. When grabber assembly 42 travels along path 25 past point 28, grabber assembly 42 may tilt, emptying the contents of the refuse container into refuse compartment 30.

Grabber Assembly

Referring now to FIGS. 5A-5D, grabber assembly 42 is shown in greater detail, according to an exemplary embodiment. Grabber assembly 42 is shown to include carriage 46, first adapter assembly 43*a* fixedly coupled with carriage 46 at the first end of carriage 46, second adapter assembly 43*a* fixedly coupled with carriage 46 at the second end of carriage 46, first grabber arm 44*a* rotatably coupled with first adapter assembly 43*a*, and second grabber arm 44b rotatably coupled with second adapter assembly 43*a*. Grabber assembly 42 also includes hooks or interfacing members, shown as hooks 48. Hooks 48 may be integrally formed with carriage 46, according to some embodiments. In some embodiments, hooks 48 are removably coupled with carriage 46 (i.e., with fasteners). Hooks 48 may assist in or facilitate removably coupling grabber assembly 42 with connecting member 26. Hooks 48 may aid in supporting the weight of grabber assembly 42 when grabber assembly 42 is coupled with connecting member 26, according to some embodiments.

Figure 5A:
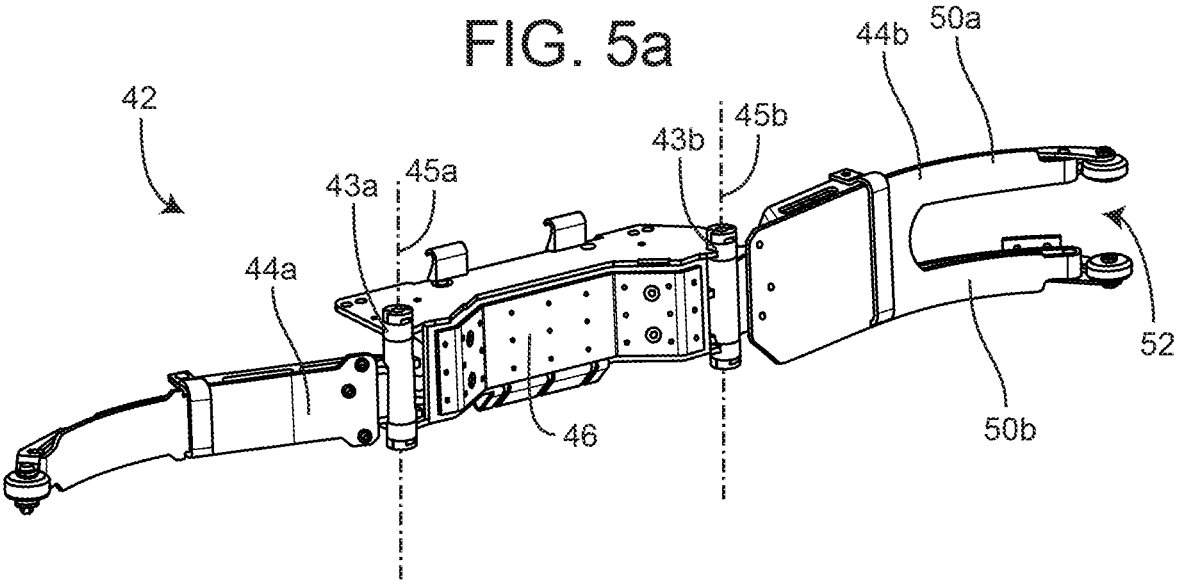
FIG. 5A is a perspective view of the grabber assembly of FIG. 1, shown to include a first grabber arm connector and a second grabber arm connector, according to an exemplary embodiment.
Figure 5B:
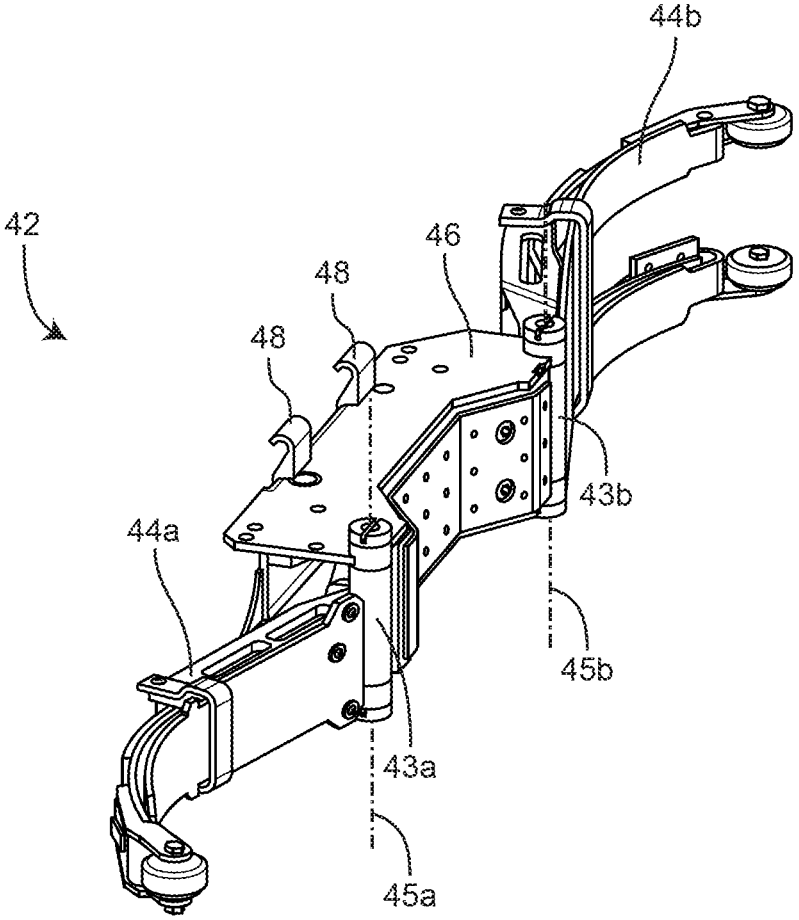
FIG. 5B is a perspective view of the grabber assembly of FIG. 1, shown to include a first grabber arm connector and a second grabber arm connector, according to an exemplary embodiment.
Figure 5C:
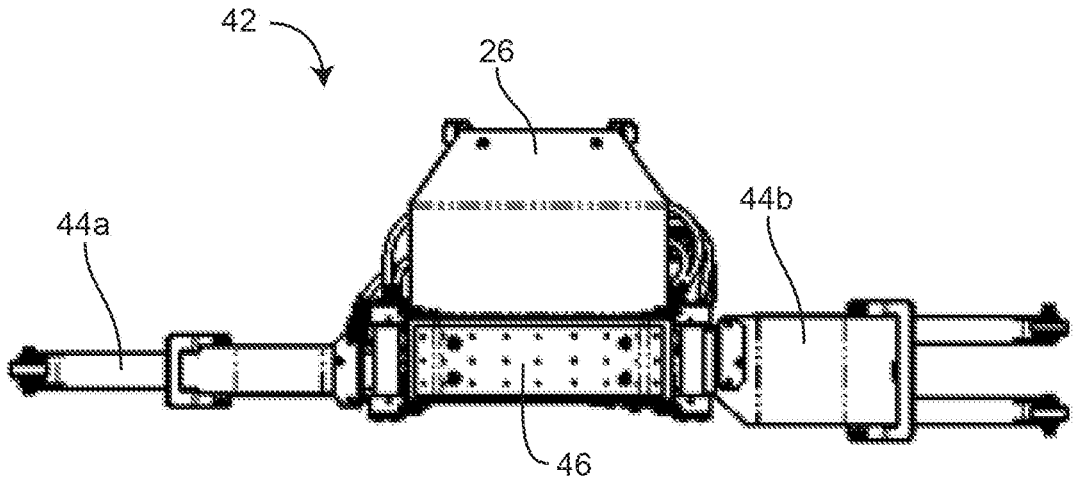
FIG. 5C is a front view of the grabber assembly of FIG. 1, shown to include a first grabber arm connector and a second grabber arm connector, according to an exemplary embodiment.
Figure 5D:
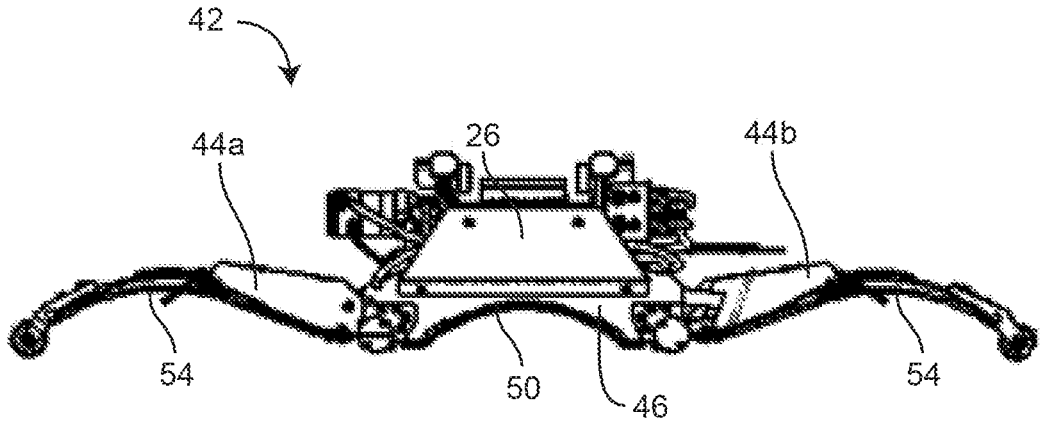
FIG. 5D is a top view of the grabber assembly of FIG. 1, shown to include a first grabber arm connector and a second grabber arm connector, according to an exemplary embodiment.

Referring to FIGS. 5C-5D, the grabber assembly 42 is shown connected to connecting member 26, according to an exemplary embodiment. Grabber assembly 42 may connect to connecting member 26 with hooks 48 and/or fasteners configured to removably connect grabber assembly 42 with connecting member 26. In FIG. 5D, carriage 46 is shown to have a curved portion 50, according to an exemplary embodiment. Curved portion 50 may assist in releasably securing or coupling grabber assembly 42 with a refuse container by interfacing with a curved portion of the refuse container, according to an exemplary embodiment. Referring still to FIG. 5D, each of first grabber arm 44*a*, and second grabber arm 44*b* are shown to include a curved portion, shown as curved portion 55, according to an exemplary embodiment. Curved portion 55 may assist in grabber assembly 42 grasping the refuse container, according to an exemplary embodiment.

Referring to FIGS. 5A-5B, grabber assembly 42 is shown to include first grabber arm 44*a* and second grabber arm 44*b*, according to an exemplary embodiment. Second grabber arm 44*b* includes a first protrusion, shown as first grabber finger 50*a*, and a second protrusion shown as second grabber finger 50*b*, according to an exemplary embodiment. First grabber finger 50*a* and second grabber finger 50*b* define an open space therebetween, shown as open space 52. Open space 52 may have a width equal to or greater than a maximum width of first grabber arm 44*a*, according to some embodiments. In some embodiments, when grabber assembly 42 transitions into an engaged state, first grabber arm 44*a* moves into the open space 52, defined by the space between first grabber finger 50*a* and second grabber finger 50*b*.

Figure 6:
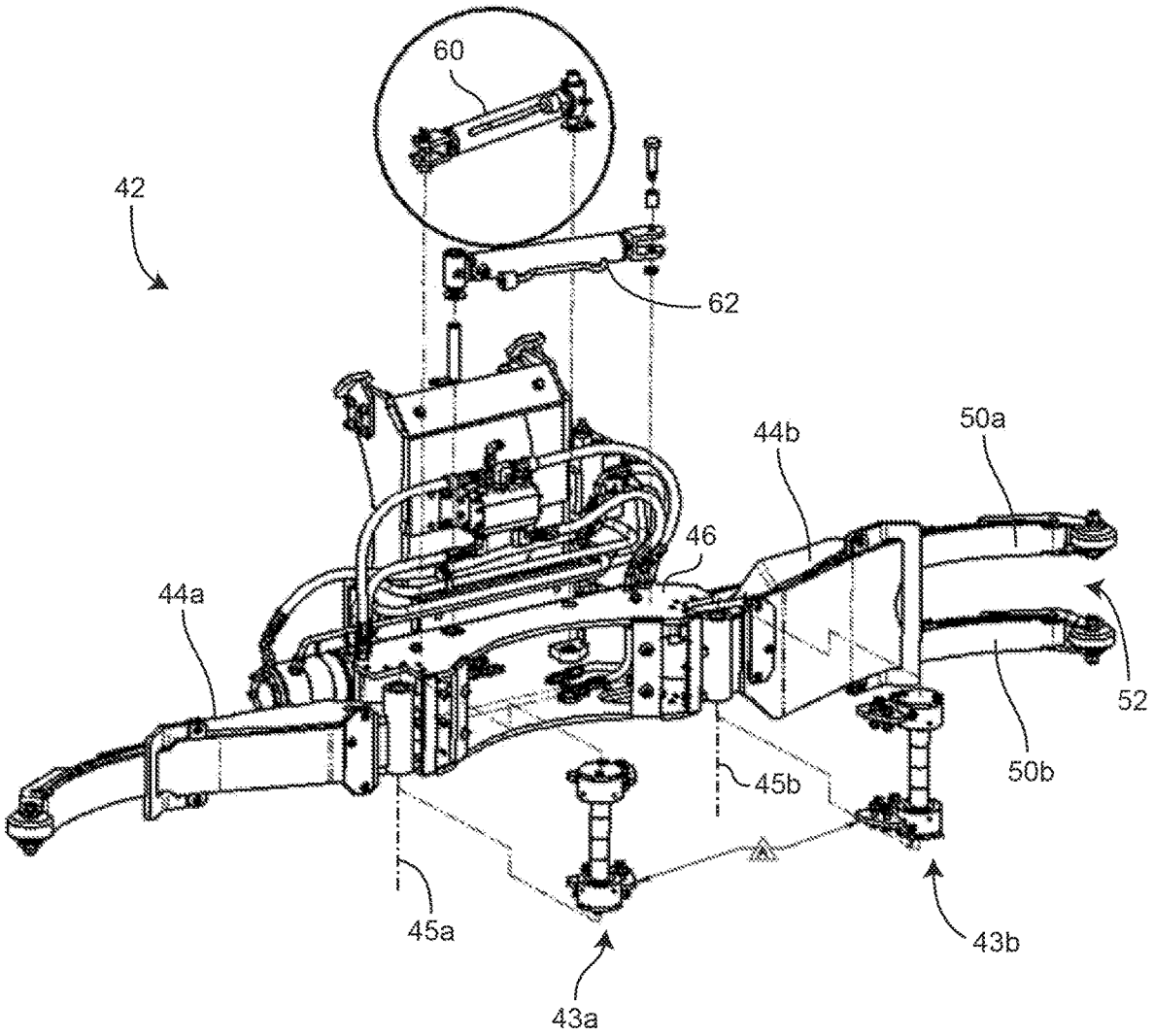
FIG. 6 is an exploded perspective view of the grabber assembly of FIG. 1, shown to include a first grabber arm connector and a second grabber arm connector, according to an exemplary embodiment.

Referring now to FIG. 6, grabber assembly 42 is shown in an exploded perspective view, according to an exemplary embodiment. Grabber assembly 42 is shown to include first adapter assembly 43*a* and second adapter assembly 43*a*, according to an exemplary embodiment. First adapter assembly 43*a* and second adapter assembly 43*a* are shown in an exploded state relative to carriage 46. Grabber assembly 42 includes one or more cylinders, shown as double-action cylinder 61 and double-action cylinder 63. In an exemplary embodiment, each of double-action cylinder 61 and double-action cylinder 63 are hydraulic cylinders and are configured to drive a corresponding one of first grabber arm 44*a*, and second grabber arm 44*b*. Double-action cylinder 61 and double-action cylinder 63 may removably pivotally couple at one end with carriage 46, and removably pivotally couple at another end (e.g., an opposite end) with first grabber arm 44*a*, and second grabber arm 44*b*, respectively. In some embodiments, each of double-action cylinder 61 and double-action cylinder 63 are pneumatic cylinders. Each of double-action cylinder 61 and double-action cylinder 63 are configured to expand/extend and retract/compress, according to an exemplary embodiment. As each of double-action cylinder 61 and double-action cylinder 63 expand, double-action cylinder 61 and double-action cylinder 63 may drive first grabber arm 44*a* and second grabber arm 44*b* to pivot about axis 45*a* and axis 45*b*, respectively. Double-action cylinder 61 and double-action cylinder 63 transition grabber assembly 42 into the engaged state by expanding, and transition grabber assembly 42 into the disengaged state by retracting.

Grabber Adapter Assembly

Figure 7:
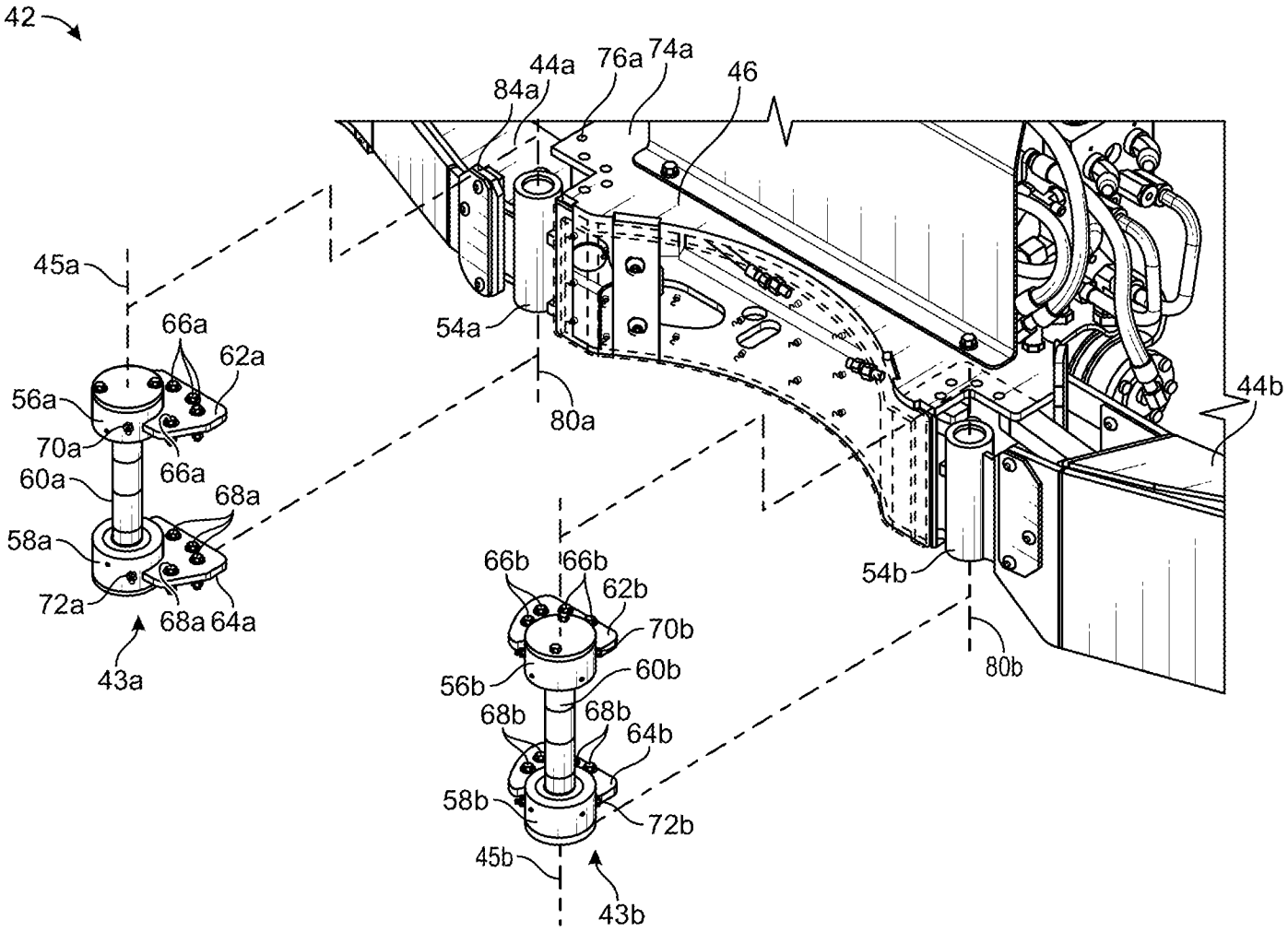
FIG. 7 is an exploded perspective view of a section of the grabber assembly of FIG. 1, shown to include a first grabber arm connector and a second grabber arm connector, according to an exemplary embodiment.

Referring now to FIG. 7, an exploded view of a portion of grabber assembly 42 is shown in greater detail, according to an illustrative embodiment. First adapter assembly 43*a* and second adapter assembly 43*b* are symmetrical, such that whatever is said of first adapter assembly 43*a* may be said of second adapter assembly 43*b*, and vice versa. First adapter assembly 43*a* is shown exploded relative to carriage 46. First adapter assembly 43*a* includes a top piece, an upper member, a first member, a receiving member, a mounting member, etc, shown as top adapter piece 56*a*, a bottom piece, a lower member, a second member, a receiving member, a mounting member, etc., shown as bottom adapter piece 58*a* and a pin, shown as adapter assembly pin 60*a*. Top adapter piece 56*a* is shown coupled with a plate, a planar member, a connection member, etc., shown as top adapter plate 62*a*, according to an exemplary embodiment. In some embodiments, top adapter plate 62*a* is integrally formed with top adapter piece 56*a*. Top adapter plate 62*a* is shown to include fasteners 66*a*, according to an exemplary embodiment. Top adapter plate 62*a* is configured to interface with, abut, contact, etc., a surface or corresponding portion of carriage 46, shown as surface 74*a* of carriage 46, and removably couples with carriage 46 through fasteners 66*a* and fastener connections 76*a*. In some embodiments, fasteners 66*a* include a bolt and a nut, and fastener connections 76*a* are through-holes or apertures configured to interface with fasteners 66*a* to removably couple first adapter assembly 43*a* with carriage 46. First adapter assembly 43*a* also includes bottom adapter piece 58*a*, according to an exemplary embodiment. Bottom adapter piece 58*a* may be constructed similarly to top adapter piece 56*a*, and can include a bottom plate, a bottom planar member, a bottom portion, etc., shown as bottom adapter plate 64*a*. Bottom adapter plate 64*a* includes bottom fasteners, shown as fasteners 68*a*, and is configured to removably couple first adapter assembly 43*a* with carriage 46. Fasteners 68*a* are shown to be the same as fasteners 66*a*, and may be configured to interface with and couple with a bottom surface of carriage 46, similar to fasteners 66a.

Referring still to FIG. 7, first adapter assembly 43*a* is shown to include adapter assembly pin 60*a*. In some embodiments, adapter assembly pin 60*a* is configured to extend through greaseless bushings as described in greater detail below with reference to FIGS. 11-15. Adapter assembly pin 60*a* is configured to pivotally interface within a connector, shown as first grabber arm connector 54*a* (e.g., a bushing) of first grabber arm 44*a*, according to an exemplary embodiment. In some embodiments, first grabber arm connector 54*a* includes greaseless bushings fit (e.g., press fit, slip fit, etc.) within an aperture of first grabber arm connector 54*a* as described in greater detail below with reference to FIGS. 11-15. Adapter assembly pin 60*a* may facilitate pivoting of first grabber arm 44*a* about axis 45*a* and may support first grabber arm 44*a*. Adapter assembly pin 60*a* is configured to extend through an entire longitudinal length of first grabber arm connector 54*a* and extends into top adapter piece 56*a* at a first or proximate end, and into bottom adapter piece 58*a* at a second or distal end, according to an exemplary embodiment. First adapter assembly 43*a* can also include a top fastener and a bottom fastener, shown as top pin fastener 70*a* and bottom pin fastener 72*a*. Top pin fastener 70*a* and bottom pin fastener 72*a* removably couple adapter assembly pin 60*a* with top adapter piece 56*a* and bottom adapter piece 58*a*, respectively. In an exemplary embodiment, top pin fastener 70*a* and bottom pin fastener 72*a* extend along axis 45*a*. Axis 45*a* may be defined as an axis extending longitudinally through a center of adapter assembly pin 60*a*. Top adapter piece 56*a* and bottom adapter piece 58*a* may be axially aligned with adapter assembly pin 60*a*, such that axis 45*a* extends through the center of top adapter piece 56*a* and bottom adapter piece 58*a*. In some embodiments, each of top pin fasteners 70*a* and bottom pin fasteners 72*a* are bolt fasteners and extend through a top hole and a bottom hole, respectively. The top hole is normal to axis 45*a*, and radially extends through top adapter piece 56*a* and the end of adapter assembly pin 60*a* which extends into top adapter piece 56*a*, according to an exemplary embodiment. The bottom hole is normal to axis 45*a* and radially extends through bottom adapter piece 58*a* and the end of adapter assembly pin 60*a* which extends into bottom adapter piece 58*a*, according to an exemplary embodiment.

Referring still to FIG. 7, first grabber arm 44*a* and second grabber arm 44*b* are shown to include first grabber arm connector 54*a* and second grabber arm connector 54*b*, according to an exemplary embodiment. First grabber arm connector 54*a* and second grabber arm connector 54*b* are configured to pivotally or rotatably couple with adapter assembly pin 60*a* and adapter assembly pin 60*b*, respectively. First grabber arm connector 54*a* and second grabber arm connector 54*b* may be similarly or symmetrically configured and constructed, such that whatever is said of first grabber arm connector 54*a* may be said of second grabber arm connector 54*b*, and vice versa. First grabber arm connector 54*a* fixedly couples (e.g., integrally formed, welded, fastened, etc.) with first grabber arm 44*a*, according to an exemplary embodiment.

Referring still to FIG. 7, each of first adapter assembly 43*a* and second adapter assembly 43*b* are shown in an exploded position relative to carriage 46. Each of top adapter piece 56*a* and bottom adapter piece 58*a* are removably coupled with adapter assembly pin 60*a*. First grabber arm connector 54*a* and second grabber arm connector 54*b* are fixedly connected to first grabber arm 44*a* and second grabber arm 44*b*, respectively. The removable coupling between first adapter assembly 43*a* and second adapter assembly 43*b* and carriage 46 are advantageous since they allow grabber assembly 42 to be quickly and easily disassembled for maintenance purposes. A technician may easily disassemble grabber assembly 42 by first de-coupling top fasteners 66*a*, bottom fasteners 68*a*, top fasteners 66*b*, and bottom fasteners 68*b* to remove first adapter assembly 43*a* and second adapter assembly 43*b*. The technician may further disassemble first adapter assembly 43*a* and second adapter assembly 43*b* by de-coupling top pin fastener 70*a*, bottom pin fastener 72*a*, top pin fastener 70*b*, and bottom pin fastener 72*b* to completely disassemble first adapter assembly 43*a* and second adapter assembly 43*b*. This allows the technician to quickly disassemble and replace various components of grabber assembly 42 and may decrease an amount of maintenance time required for the refuse vehicle 10, allowing refuse vehicle 10 to quickly return to operation.

In some embodiments, the removable couplings described also allow the technician to adjust an alignment of the adapter assembly pin (e.g., adapter assembly pin 60*a*) within the bushing (e.g., first grabber arm connector 54*a*). For example, if top fasteners 66*a* and bottom fasteners 68*a* are bolt fasteners, fastener connections 76*a* may be through holes, configured to interface with fasteners 66*a*. The diameters of fastener connections 76*a* may be large enough to allow fasteners 66*a* to be adjusted within the diameter of fastener connections 76*a*, to adjust the alignment of adapter assembly pin 60*a* within grabber arm connector 54*a*. The technician may loosen top fasteners 66*a* or bottom fasteners 68*a* and adjust a position of top fasteners 66*a* or bottom fasteners 68*a* within fastener connections 76*a*. Once a desired alignment has been achieved between top adapter piece 56*a* and bottom adapter piece 58*a* (or top adapter piece 56*b* and bottom adapter piece 58*b*), the technician may selectably tighten top fasteners 66*a* and/or bottom fasteners 68*a* to maintain the desired alignment.

In some embodiments, grabber assembly 42 includes polymeric wear surfaces. For example, an inner diameter of first grabber arm connector 54*a* may undergo wear due to the interface or relative motion between the inner diameter of first grabber arm connector 54*a* and an outer diameter of adapter assembly pin 60*a*. In order to provide proper lubrication and/or wear resistance, a polymeric surface may be applied to at least one of the outer diameter of adapter assembly pin 60*a* and the inner diameter of first grabber arm connector 54*a*, according to an exemplary embodiment. The polymeric wear surface may be any of a surface made of polyethylene, polytetrafluoroethylene, polypropylene, polyisobutylene, polystyrene, polyvinylchloride, polyehterketone, polyoxymethylene, polyimide, etc., or any other polymer. In some embodiments, the polymeric wear surface may be a sleeve removably inserted into first grabber arm connector 54*a* or over adapter assembly pin 60*a*. Advantageously, polymeric wear surfaces reduce the need to periodically grease the wear surfaces of grabber assembly 42. This may result in cost and time savings by providing a greaseless grabber assembly.

Figure 8:
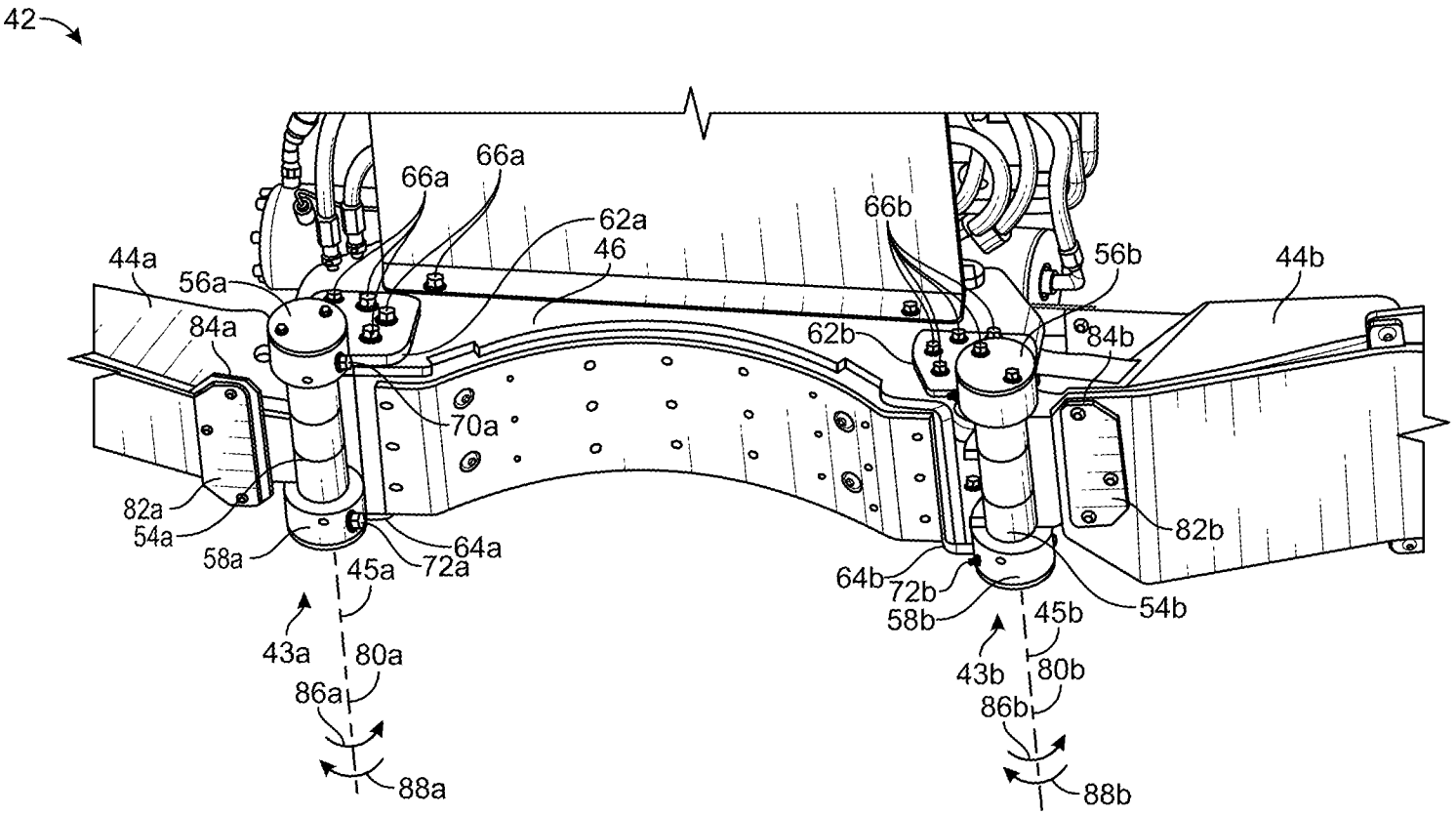
FIG. 8 is a perspective view of a section of the grabber assembly of FIG. 1, according to an exemplary embodiment.

Referring now to FIG. 8, a perspective view of a portion of grabber assembly 42 is shown, according to an exemplary embodiment. Grabber assembly 42 is shown in an assembled state. In the assembled state, adapter assembly 43*a* and adapter assembly 43*b* are removably coupled with carriage 46 through fasteners 66*a* and fasteners 66*b*, respectively. Additionally, the assembled state shows axis 45*a* and axis 80*a* coaxial with each other. First grabber arm connector 54*a* and second grabber arm connector 54*b* are shown fixedly coupled with first grabber arm 44*a* and second grabber arm 44*b*. Grabber arm 44*a* is configured to be driven by double-action cylinder 61 and grabber arm 44*b* is configured to be driven by double-action cylinder 63. As double-action cylinder 61 and double-action cylinder 63 extend, grabber arm 44*a* is driven to rotate about axis 45a/80*a* in direction 86*a* and grabber arm 44*b* is driven to rotate about axis 45b/80*b* in direction 86*b*, according to an exemplary embodiment. Grabber arm 44*a* and grabber arm 44*b* may rotate in direction 86*a* and direction 86*b*, respectively, until grabber assembly 42 is in the engaged state, defined by the refuse container being sufficiently grasped by each of grabber arm 44*a* and grabber arm 44*b*. Since different refuse containers may have different widths, diameters, and shapes, the engaged state may vary depending on an amount of rotation of grabber arm 44*a* and grabber arm 44*b* in direction 86*a* and direction 86*b* required to sufficiently grasp the particular refuse container. Once the grabber assembly 42 has transitioned into the engaged state and sufficiently grasps the refuse container, the grabber assembly 42 may be transported along track 20 until the refuse container is emptied. The refuse container is then returned to the ground, and the grabber assembly 42 is transitioned into the disengaged state by retracting each of double-action cylinder 61 and double-action cylinder 63. The retraction of double-action cylinder 61 and double-action cylinder 63 causes first grabber arm 44*a* to rotate about axis 45a/80*a* in direction 88*a* and second grabber arm 44*b* to rotate about axis 45b/80*b* in direction 88*b* until the refuse container is no longer grasped by the grabber assembly 42.

Figure 9:
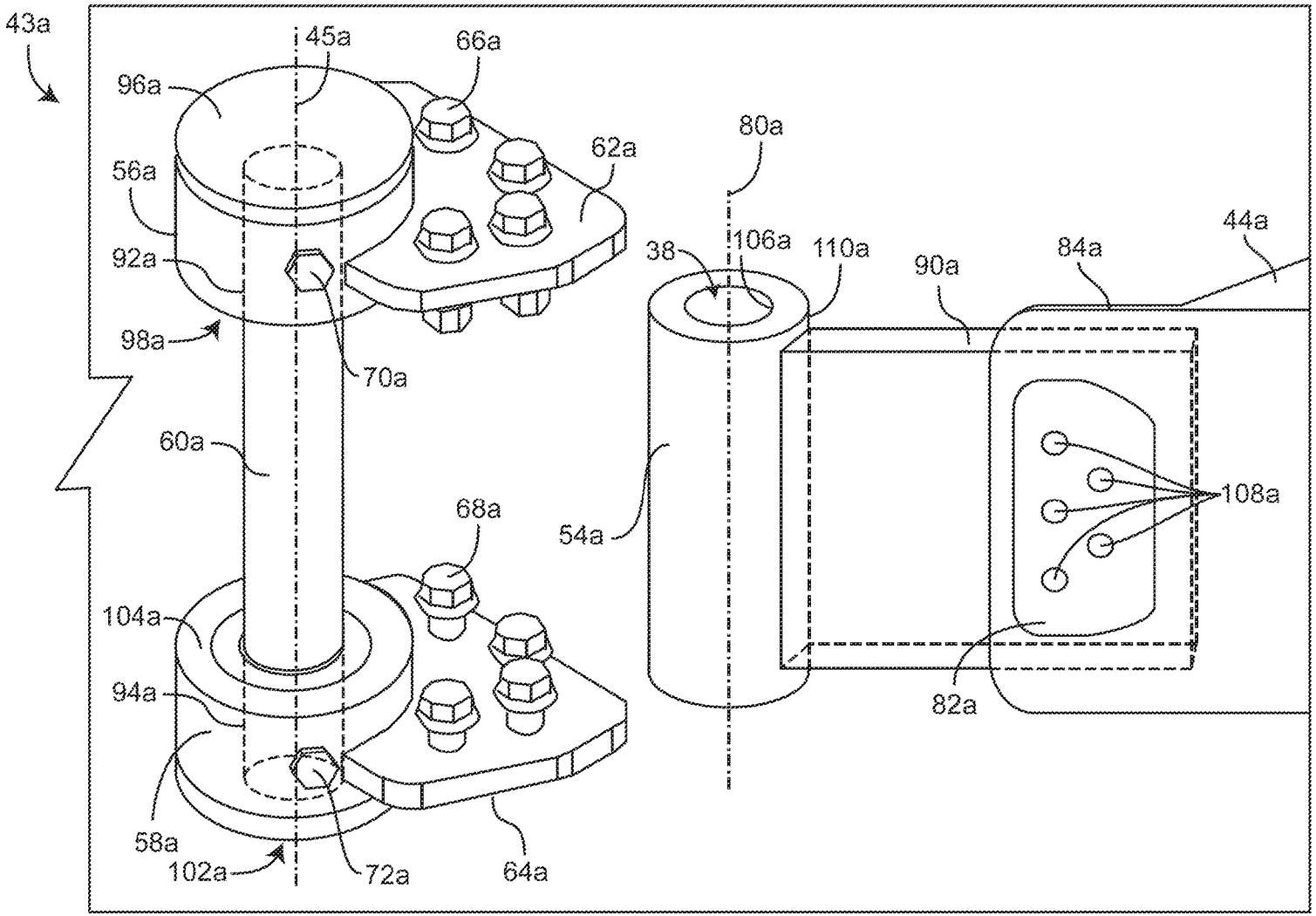
FIG. 9 is an exploded perspective view of a section of the grabber assembly of FIG. 1, showing an interface between a grabber arm and one of the first grabber arm connector and the second grabber arm connector, according to an exemplary embodiment.

Referring now to FIG. 9, a detailed perspective view of first adapter assembly 43*a* and the interface between first adapter assembly 43*a* and first grabber arm 44*a* is shown, according to an exemplary embodiment. As shown in FIG. 9, a first end of adapter assembly pin 60*a*, shown as first end 92*a* protrudes into top adapter piece 56*a*, and a second end of adapter assembly pin 60*a*, shown as second end 94*a* protrudes into bottom adapter piece 58*a*, according to an exemplary embodiment. First end 92*a* of adapter assembly pin 60*a* is prevented from rotating within top adapter piece 56*a* by top pin fastener 70*a*, which extends through top adapter piece 56*a* and first end 92*a* of adapter assembly pin 60*a*, normally to axis 45*a*. Top pin fastener 70a may be a bolt fastener, according to an exemplary embodiment and may removably couple first end 92*a* of adapter assembly pin 60*a* with top adapter piece 56*a*. Second end 94*a* of adapter assembly pin 60 is prevented from rotating within bottom adapter piece 58*a* similarly to first end 92*a* of adapter assembly pin 60, via bottom pin fastener 72*a*, according to an exemplary embodiment.

Referring still to FIG. 9, first adapter assembly 43*a* includes top adapter plate 62*a* and bottom adapter plate 64*a*, according to an exemplary embodiment. Top adapter plate 62*a* may be integrally formed with top adapter piece 56*a*, and bottom adapter plate 64*a* may be integrally formed with bottom adapter piece 58*a*, according to an exemplary embodiment. Top adapter plate 62*a* and bottom adapter plate 64*a* may be generally parallel to each other, and may have a same or similar thickness, according to an exemplary embodiment. In some embodiments, top adapter piece 56*a* include a top face 96*a* and a bottom face 98*a*. Top adapter plate 62*a* may be positioned at a midpoint between top face 96*a* and bottom face 98*a* of top adapter piece 56*a*, according to some embodiments. In some embodiments, top adapter plate 62*a* may be positioned such that a top face of top adapter plate 62*a* is coplanar with top face 96*a* of top adapter piece 56*a*. In some embodiments, top adapter plate 62*a* is positioned such that a bottom face of top adapter plate 62*a* is coplanar with bottom face 98*a* of top adapter piece 56*a*. Likewise, bottom adapter plate 64*a* may be positioned at a midpoint between top face 104*a* and bottom face 102*a* of bottom adapter piece 58*a*, or such that a top face of bottom adapter plate 64*a* is coplanar with top face 104*a* of bottom adapter piece 58*a*, or such that a bottom face of bottom adapter plate 64*a* is coplanar with bottom face 102*a* of bottom adapter piece 58*a*, according to various embodiments. The distance between the bottom face of top adapter plate 62*a* and the top face of bottom adapter plate 64*a* may be substantially equal to a width of carriage 46 at a specific location where first adapter assembly 43*a* is configured to removably coupled with carriage 46.

Referring still to FIG. 9, top adapter plate 62*a* is shown to include fasteners 66*a*, and bottom adapter plate 64*a* is shown to include fasteners 68*a*, according to an exemplary embodiment. As described in greater detail above with reference to FIG. 7, fasteners 68*a* and fasteners 66*a* may be configured to removably couple first adapter assembly 43*a* with carriage 46. In the embodiment shown in FIG. 9, fasteners 68*a* and fasteners 66*a* are bolts, however, fasteners 68*a* and fasteners 66*a* can be any other type of fastener (e.g., a pin). Any number of fasteners 66*a* and fasteners 68*a* may be used, according to some embodiments. The embodiment in FIG. 9 shows four fasteners 66*a* and four fasteners 68*a*, however, more or less than four fasteners may be used according to some embodiments.

Referring still to FIG. 9, first grabber arm connector 54*a* is shown fixedly coupled with first grabber arm 44*a*, in greater detail. First grabber arm connector 54*a* is shown to include an inner volume 38, an inner surface 106*a*, and an outer surface 110*a*, according to an exemplary embodiment. In the exemplary embodiment shown, inner surface 106*a* and outer surface 110a are cylindrical in shape and are both coaxial about axis 80*a*. Inner surface 106*a* may have a diameter substantially equal to or slightly greater than an outer diameter of adapter assembly pin 60*a*, and may be configured so that adapter assembly pin 60*a* extends through an aperture of first grabber arm connector 54*a*. In some embodiments, first grabber arm connector 54*a* fixedly couples with first grabber arm 44*a* at a corner of first grabber arm 44*a*. First grabber arm connector 54*a* may be integrally formed or fixedly coupled with first grabber arm 44a.

Referring still to FIG. 9, various surfaces of first adapter assembly 43*a* and first grabber arm connector 54*a* may include a wear-resistant material. An outer surface of adapter assembly pin 60*a* may include a polymeric wear resistant material, according to an exemplary embodiment. Additionally, inner surface 106*a* of first grabber arm connector 54*a* may include a polymeric wear resistant material. The polymeric wear resistant material may be any of the polymeric materials mentioned above with reference to FIG. 7. When first adapter assembly 43*a* and first grabber arm connector 54*a* are assembled, axis 45*a* and axis 80*a* are coaxial and adapter assembly pin 60*a* extends through grabber arm connector 54*a*, facilitating rotation of first grabber arm 44*a* about axis 45*a*/axis 80*a*. When first grabber arm 44*a* rotates about axis 45*a*/axis 80*a* (i.e., when grabber assembly 42 transitions between the engaged and disengaged state), the outer surface of adapter assembly pin 60*a* and the inner surface 106*a* of grabber arm connector 54*a* may slidably interface with each other. The polymeric wear materials present on the outer surface of adapter assembly pin 60*a* and/or the inner surface 106*a* of grabber arm connector 54*a* may reduce frictional forces between the outer surface of adapter assembly pin 60*a* and the inner surface 106*a* of grabber arm connector 54*a*, providing a low-friction, greaseless interface.

Referring now to FIGS. 11-14, first adapter assembly 43*a* is shown, according to some embodiments. First adapter assembly 43*a* is shown to include greaseless sleeves (e.g., a polymeric sleeve bearing, a plain bearing, a polymeric bushing, etc.), shown as greaseless bushing 112*a*, greaseless bushing 112*b*, greaseless bushing 112*c*, and greaseless bushing 112*d*, according to some embodiments. In some embodiments, each of greaseless bushing 112*a*, greaseless bushing 112*b*, greaseless bushing 112*c*, and greaseless bushing 112*d* includes or is formed from a polymeric material. The polymeric material of each of greaseless bushing 112*a*, greaseless bushing 112*b*, greaseless bushing 112*c*, and greaseless bushing 112*d* may be any of the polymeric materials discussed in greater detail above with reference to FIG. 7.

Figure 12:
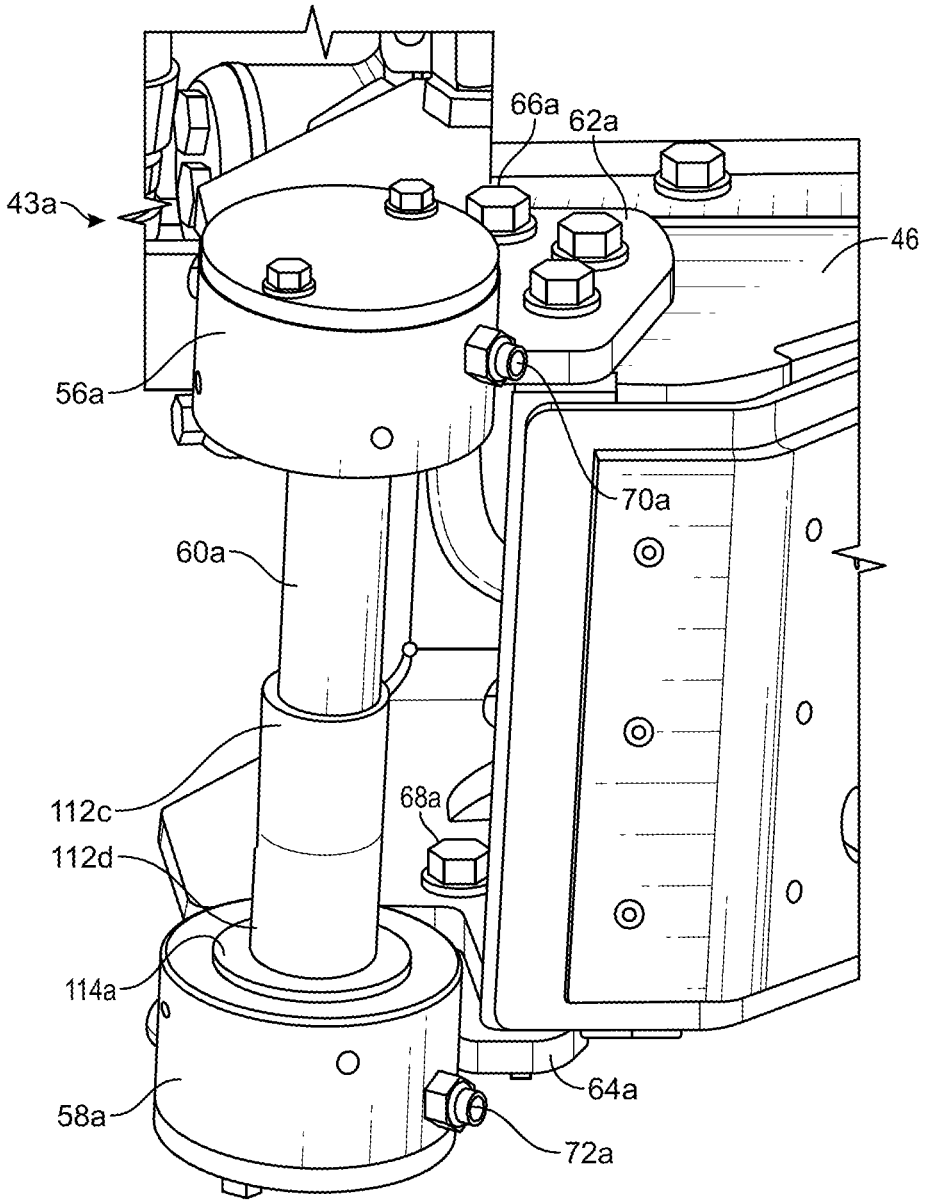
FIG. 12 is a perspective view of the adapter assembly of the grabber assembly of FIG. 1, according to an exemplary embodiment.

In the exemplary embodiment shown in FIGS. 11-14 (FIG. 12 shows only greaseless bushing 112*c* and greaseless bushing 112*d* for illustrative purposes), four greaseless bushings 112 are used (i.e., greaseless bushing 112*a*, greaseless bushing 112*b*, greaseless bushing 112*c*, and greaseless bushing 112*d*). In some embodiments, more than four greaseless bushings 112 may be used. In some embodiments, less than four greaseless bushings 112 may be used. Greaseless bushings 112*a*-112*d* may be fit (e.g., press fit, slip fit, etc.) into grabber arm connector 54*a*, according to some embodiments. Greaseless bushings 112*a*-112*d* may be slip fit on adapter assembly pin 60*a* in some embodiments. In some embodiments, greaseless bushings 112*a*-112*d* facilitate a slidable coupling between adapter assembly pin 60*a* and an inner surface of greaseless bushings 112*a*-112*d*. Greaseless bushings 112*a*-112*d* may provide a wear surface between an external surface of a portion of adapter assembly pin 60*a* which extends through grabber arm connector 54*a* and an internal surface of grabber arm connector 54*a*. In some embodiments, a washer, shown as washer 114*a*, may disposed on a bottom surface of grabber arm connector 54*a*. Washer 114*a* may include a hole or central apertures through which greaseless bushing 112*d* protrudes or extends.

Figure 13:
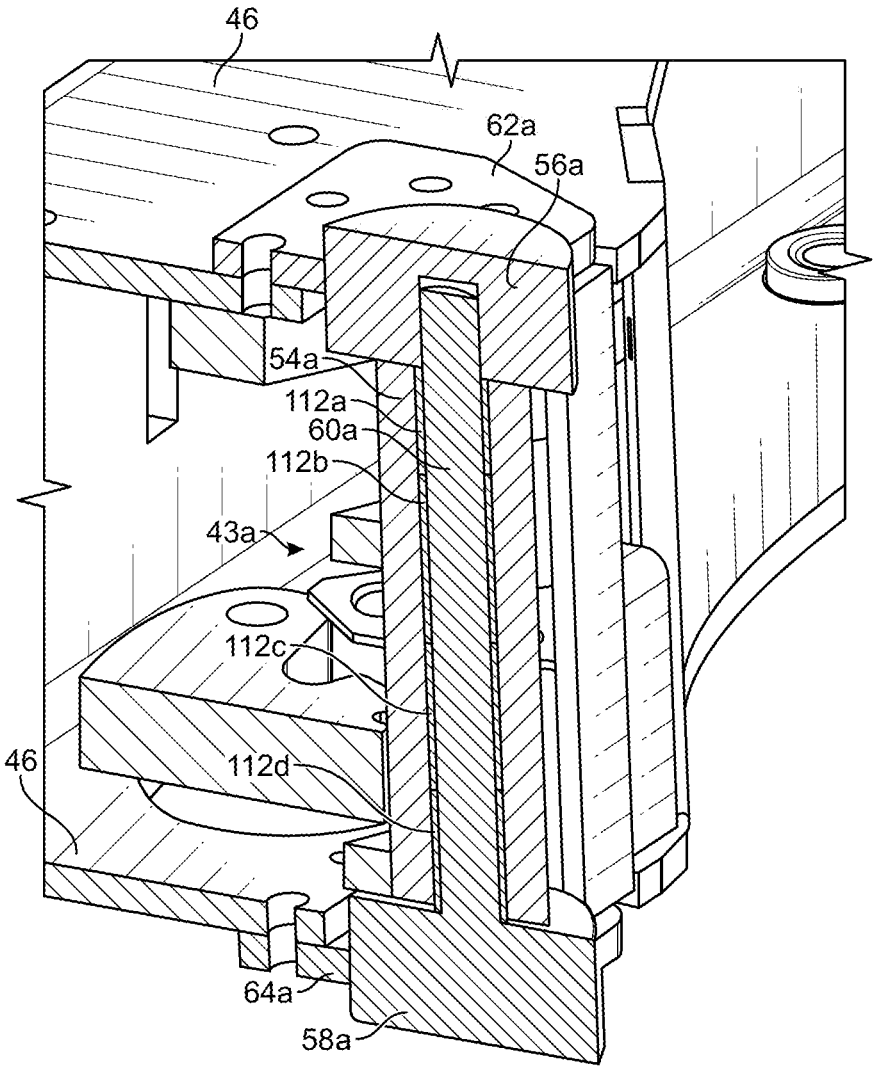
FIG. 13 is a perspective sectional view of the adapter assembly of the grabber assembly of FIG. 1, according to an exemplary embodiment.
Figure 14:
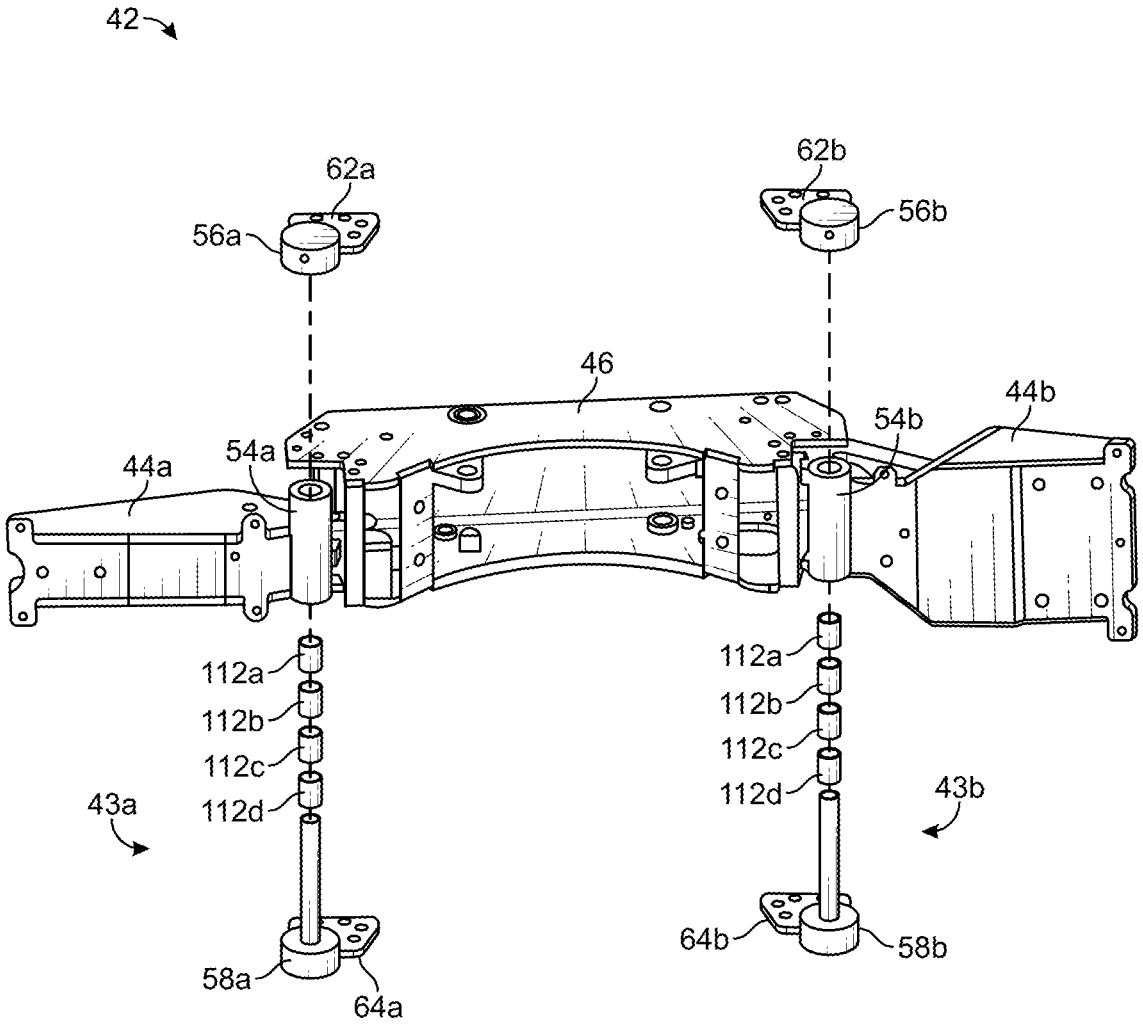
FIG. 14 is an exploded perspective view of a section of the grabber assembly of FIG. 1, according to an exemplary embodiment.
Figure 15:
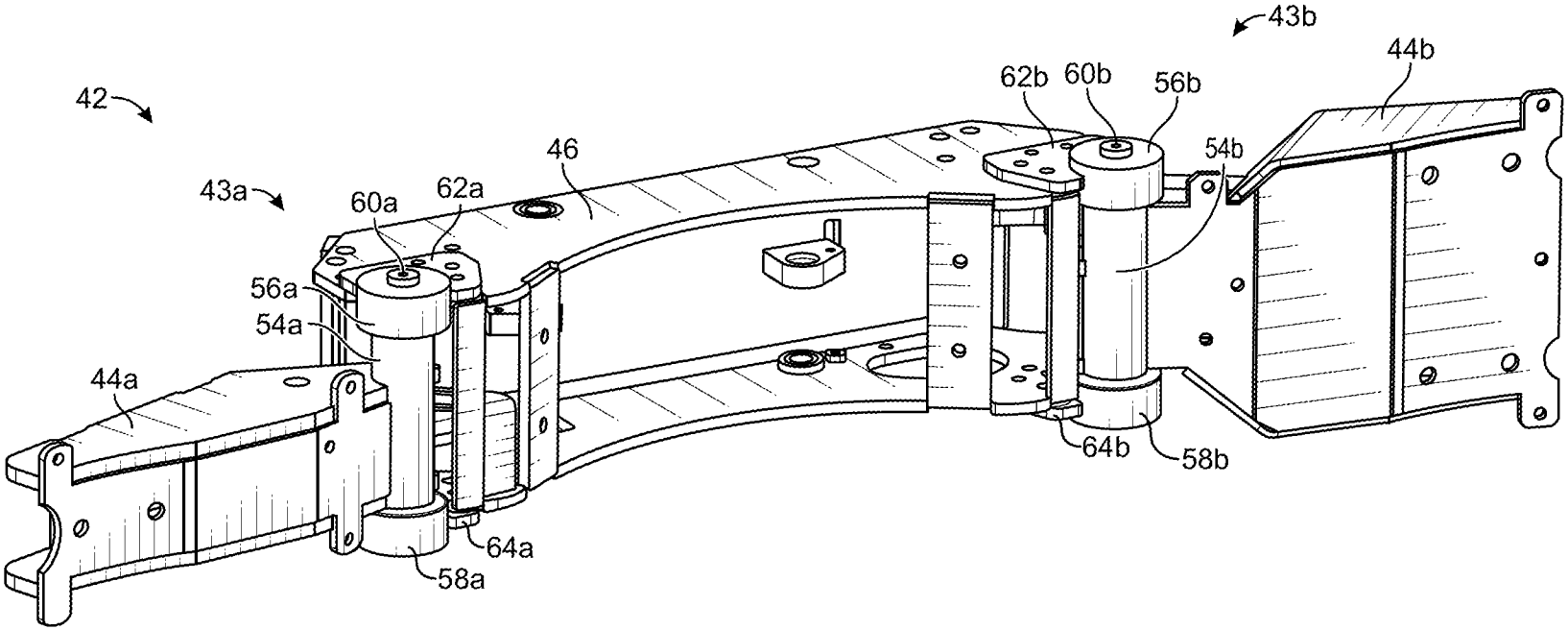
FIG. 15 is a perspective view of a section of the grabber assembly of FIG. 1, according to an exemplary embodiment.

Referring now to FIGS. 13-15, first adapter assembly 43*a* is shown, according to another embodiment. In the embodiment shown in FIGS. 13-15, bottom adapter piece 58*a* is integrally formed with adapter assembly pin 60*a*. In some embodiments, top adapter piece 56*a* and adapter assembly pin 60*a* are integrally formed while bottom adapter piece 58*a* and adapter assembly pin 60*a* are not integrally formed. Each of first adapter assembly 43*a* and second adapter assembly 43*b* are shown to slidably couple with a set of greaseless bushings 112*a*-112*d* that are disposed within grabber arm connector 54*a* and grabber arm connector 54*b*, respectively. In the embodiment shown in FIGS. 13-15, adapter assembly pin 60*a* is integrally formed with bottom adapter piece 58*a*, and protrudes partially into top adapter piece 56*a*. In some embodiments, top adapter piece 56*a* includes top pin fastener 70*a* to removably couple top adapter piece 56*a* with adapter assembly pin 60*a*.

Figure 16:
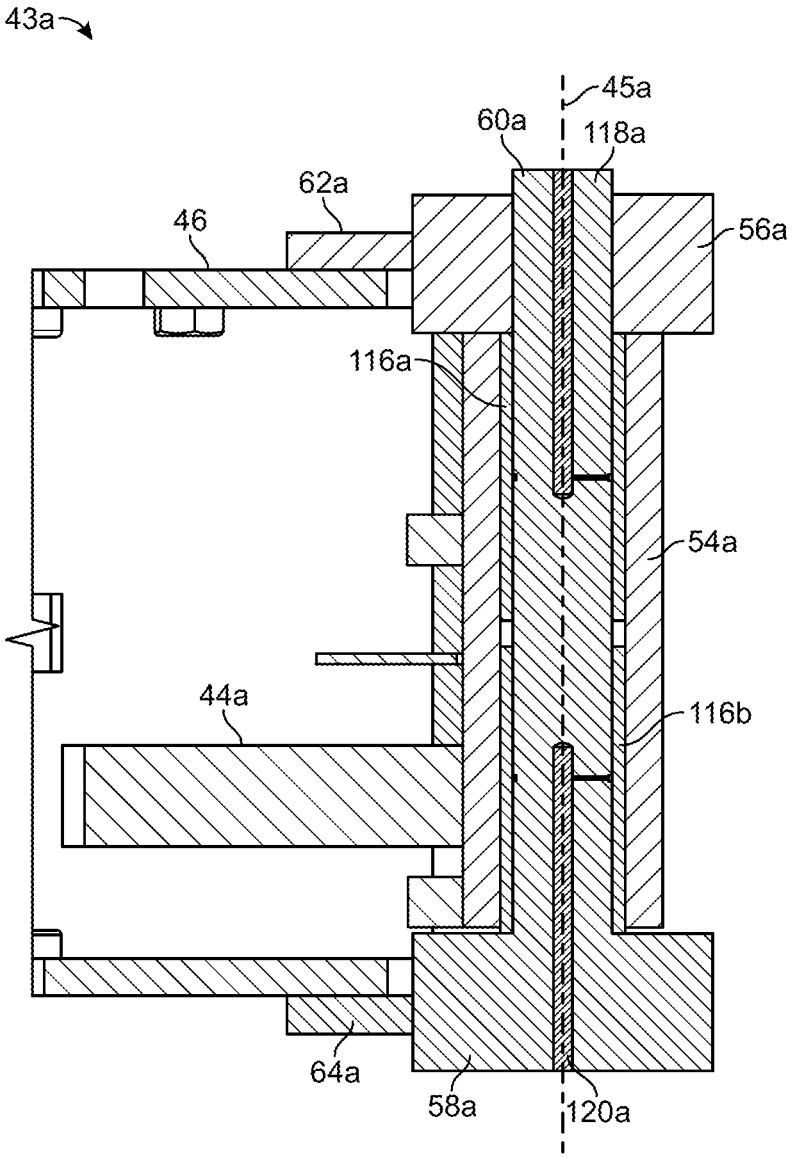
FIG. 16 is a sectional view of the adapter assembly of the grabber assembly of FIG. 1, according to an exemplary embodiment.
Figure 17:
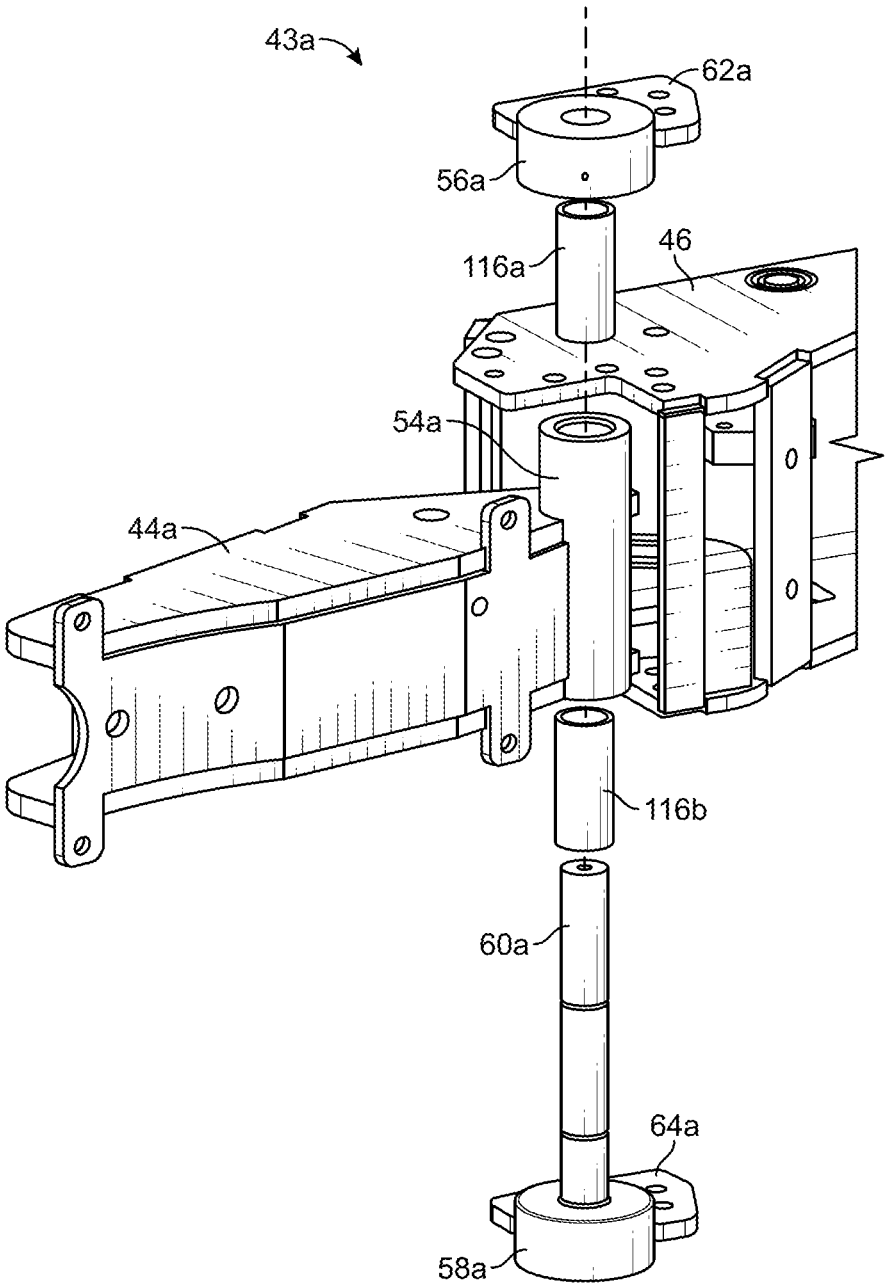
FIG. 17 is an exploded view of the adapter assembly of FIG. 1, according to an exemplary embodiment.

Referring now to FIGS. 16-17, first adapter assembly 43*a* is shown according to another embodiment. First adapter assembly 43*a* is shown to include bushings (i.e., greaseable sleeve bearings, steel bushings, etc.), shown as greaseable bushing 116*a* and greaseable bushing 116*b*. Greaseable bushing 116*a* and greaseable bushing 116*b* may be disposed in the same location (i.e., press fit, slip fit, etc., within grabber arm connector 54*a*) as greaseless bushings 112*a*-112*d* and may function in the same manner as greaseless bushings 112*a*-112*d* (i.e., facilitating a reduced friction slidable coupling between adapter assembly pin 60*a* and grabber arm connector 54*a*), as described in greater detail above with reference to FIGS. 11-15. In the embodiment shown in FIGS. 16-17, bottom adapter piece 58*a* is integrally formed with adapter assembly pin 60*a*. In some embodiments, top adapter piece 56*a* is integrally formed with adapter assembly pin 60a.

Referring still to FIGS. 16-17, adapter assembly pin 60*a* is shown protruding through and out of top adapter piece 56*a*, according to an exemplary embodiment. Adapter assembly pin 60*a* and bottom adapter piece 58*a* are shown to include passageways configured to receive and deliver lubrication (i.e., grease), to each of greaseable bushing 116*a* and greaseable bushing 116*b*, according to an exemplary embodiment. In some embodiments, a first passageway 118*a* is configured to receive lubrication through a top surface of adapter assembly pin 60*a* and deliver the lubrication to greaseable bushing 116*a* and a second passageway 120*a* is configured to receive lubrication through a bottom surface of bottom adapter piece 58*a* and deliver lubrication to greaseable bushing 116*b*. In some embodiments, each of the first passageway 118*a* and the second passageway 120*a* include a first portion extending through axis 45*a*, and one or more second portions extending radially outwards from axis 45*a* configured to supply the lubrication to either greaseable bushing 116*a* or greaseable bushing 116*b*. In some embodiments, the second portion supplies lubrication to a radial groove of adapter assembly pin 60*a* configured to distribute the lubrication about an inside surface of one of greaseable bushing 116*a* and greaseable bushing 116b.

Figure 23:
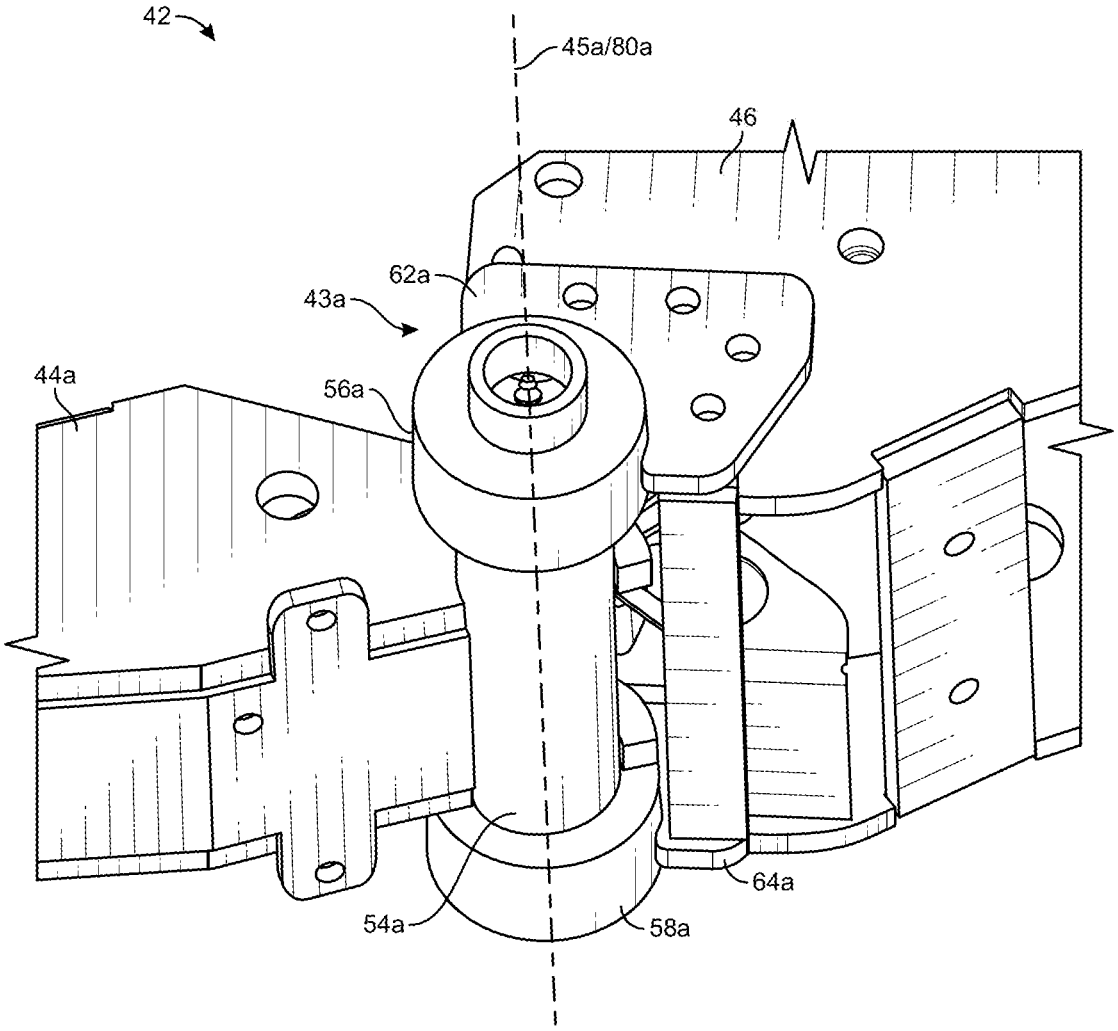
FIG. 23 is a perspective view of the adapter assembly of FIG. 1, according to an exemplary embodiment.
Figure 24:
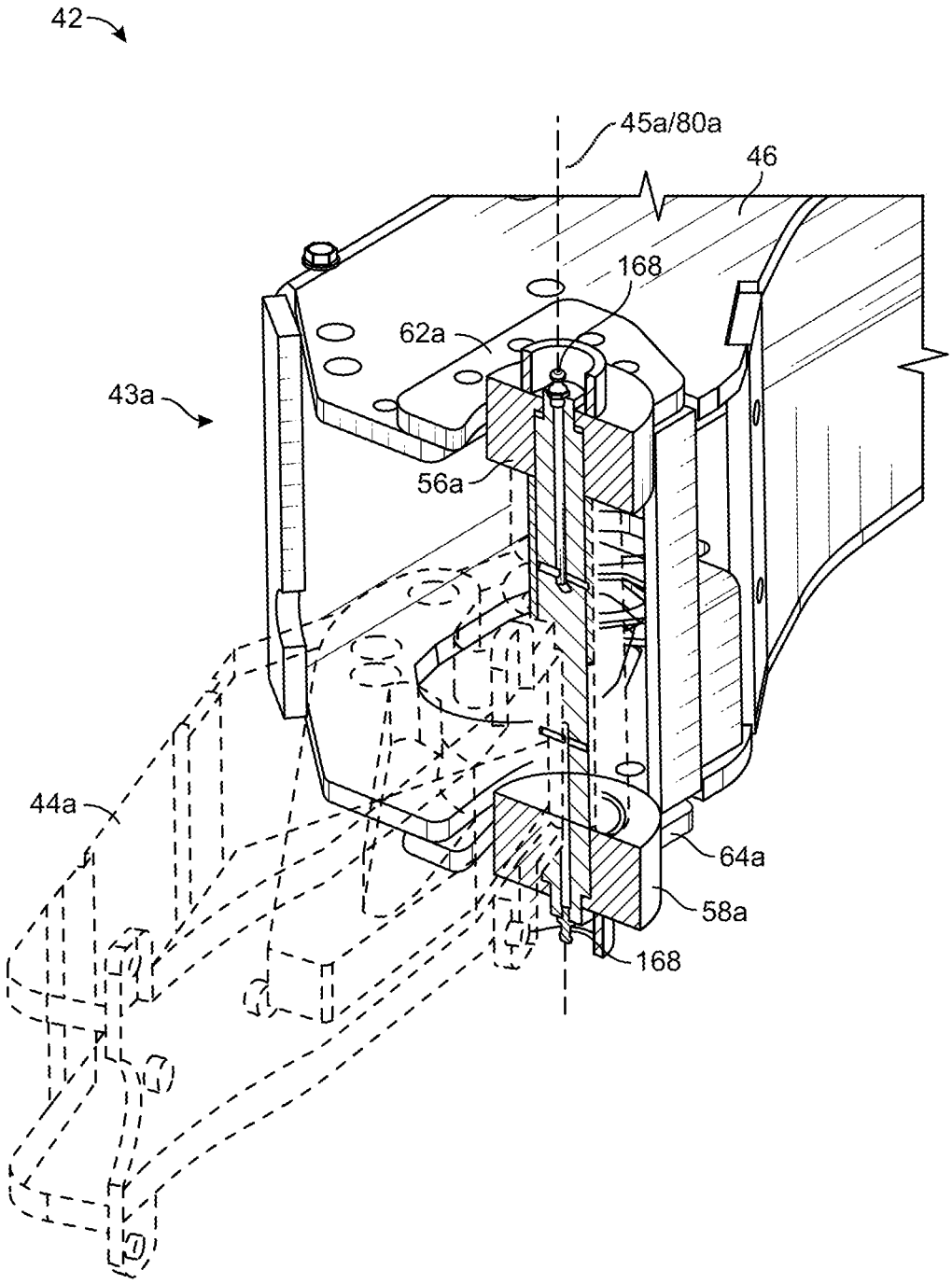
FIG. 24 is a perspective cross-sectional view of the adapter assembly of FIG. 23, according to an exemplary embodiment.
Figure 25:
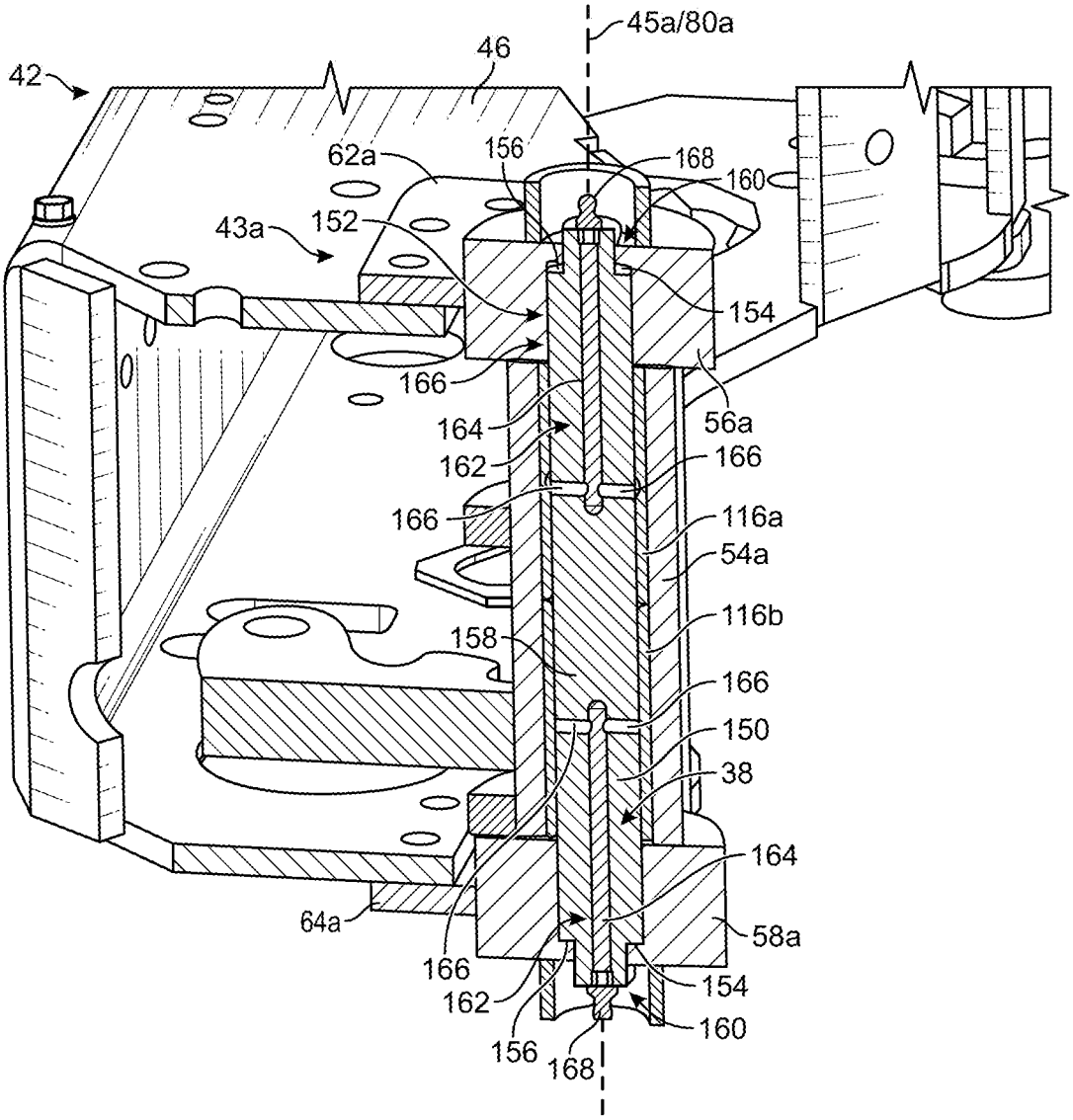
FIG. 25 is a perspective cross-sectional view of the adapter assembly of FIG. 23, according to an exemplary embodiment.

Referring now to FIGS. 23-25, a portion of grabber assembly 42 is shown. Grabber assembly 42 includes first adapter assembly 43*a*, according to another embodiment. First adapter assembly 43*a* can be the same as or similar to first adapter assembly 43*a* as described in greater detail above with reference to FIGS. 3, 5A-5D, 6-9, and 11-17, and may share any of the features or configuration as described hereinabove.

Referring particularly to FIGS. 24-25, first adapter assembly 43*a* includes top adapter piece 56*a*, bottom adapter piece 58*a*, first grabber arm connector 54*a*, greaseable bushing 116*a*, greaseable bushing 116*b*, and a pin, elongated member, cylindrical member, post, etc., shown as pin 158. Pin 158 can have a cylindrical cross-sectional shape and extends through greaseable bushing 116*a* and greaseable bushing 116*b*. Greaseable bushing 116*a* and greaseable bushing 116*b* can be hollow cylindrical members including an inner volume or central aperture through which pin 158 extends or protrudes.

Top adapter piece 56*a* and bottom adapter piece 58*a* may be similarly configured such that whatever is said of top adapter piece 56*a* may be said of bottom adapter piece 58*a* and vice versa. Top adapter piece 56*a* includes a central aperture, an inner volume, a space, a void, a stepped bore, etc., shown as receiving volume 152. Receiving volume 152 can be configured to receive a correspondingly shaped end portion, stepped portion, end, etc., of pin 158, shown as stepped end 160. Stepped end 160 includes a step or a shoulder, shown as step 156. Step 156 may be defined between various portions of pin 158 that have different outer diameters or radii. For example, a central portion 150 of pin 158 may have an outer diameter or outer radius that is greater than the radius or diameter of distal ends of pin 158. Top adapter piece 56*a* includes a step or a shoulder, shown as shoulder 154 such that receiving volume 152 has a shape corresponding to stepped end 160. In some embodiments, shoulder 154 of top adapter piece 56*a* is configured to engage, abut, slidably couple with, etc., step 156 of stepped end 160 of pin 158. Shoulder 154 can facilitate preventing removal of pin 158 during operation.

Top adapter piece 56*a* can include a central aperture or hole that is configured to receive an outer end portion of pin 158 therethrough. Pin 158 can include various passageways, pathways, passages, inner volumes, channels, flow paths, grease paths, etc., shown as grease passageway 162. Grease passageway 162 can include a central channel, a longitudinally extending channel, etc., shown as central passageway 164. Grease passageway 162 can also include one or more radial passageways, radial channels, radially extending holes, radially extending inner volumes, etc., shown as radially extending passageways 166. Radially extending passageways 166 extend radially outwards from and fluidly couple with central passageway 164. Central passageway 164 may fluidly couple with a grease fitting 168 that protrudes outwards from an outermost surface of pin 158 (e.g., that protrudes longitudinally outwards from stepped end 160). Radially extending passageways 166 can extend radially outwards through a radially outermost surface of pin 158 to thereby fluidly couple with greaseable bushing 116*a* and/or greaseable bushing 116*b*.

Greaseable bushings 116*a* and 116*b* can be sleeves that includes a radially inwards facing surface that engages or slidably couples with the radially outermost surface of pin 158. Greaseable bushings 116*a* and 116*b* also include a radially outwards facing surface that can slidably engage or slidably couple with a corresponding radially inwards facing surface of first grabber arm connector 54*a*. In some embodiments, greaseable bushings 116*a* and 116*b* are fixedly coupled within first grabber arm connector 54*a*. For example, greaseable bushings 116*a* and 116*b* can be press fit or slip fit within first grabber arm connector 54*a* so that greaseable bushings 116*a* and 116*b* are stationary relative to first grabber arm connector 54*a*. While greaseable bushings 116*a* and 116*b* are stationary relative to first grabber arm connector 54*a*, pin 158 can be free to rotate or pivot relative to greaseable bushings 116*a*.

Pin 158 can extend longitudinally along axes 45*a*/80*a*. Greaseable bushings 116*a* and 116*b* circumferentially surround pin 158. Greaseable bushings 116*a* and 116*b* are positioned within inner volume 38 of first grabber arm connector 54*a*. In this way, pin 158, greaseable bushings 116*a* and 116*b*, and first grabber arm connector 54 are co-cylindrical with each other about axes 45a/80*a* when grabber assembly 42 is assembled.

Grease or lubricant may be selectably added to first adapter assembly 43*a* through grease fittings 168 (e.g., by a technician). Pin 158 can include grease fittings 168 and grease passageway 162 at both ends of pin 158. Grease fitting 168 and grease passageway 162 at a first or proximate end of pin 158 can be configured to receive and deliver grease or lubricant to greaseable bushing 116*a*, while the other grease fitting 168 and grease passageway 162 (e.g., at an opposite, second, or distal end) of pin 158 can be configured to receive and deliver grease or lubricant to greaseable bushing 116*b*. In this way, grease may be added to first adapter assembly 43*a* from either end (e.g., from the first or proximate end and/or from the second or distal end). When grease or lubricant is added to first adapter assembly 43*a*, the lubricant enters central passageway 164 through the corresponding grease fitting 168. The lubricant may flow longitudinally through central passageway 164 until reaching radially extending passageways 166. The lubricant then flows through radially extending passageways 166 to greaseable bushing 116*a* and/or greaseable bushing 116*a*. The lubricant may be delivered to a space or gap 180 defined between a radially inwards facing surface 182 of greaseable bushings 116*a*/116*b* and a radially outwards facing surface 184 of pin 158.

It should be understood that first adapter assembly 43*a* and second adapter assembly 43*b* may be similarly and symmetrically configured such that whatever is said of first adapter assembly 43*a* may be said of second adapter assembly 43*b* and vice versa. For example, second adapter assembly 43*b* can include a similar pin 158, greaseable bushings 116*a* and 116*b*, etc.

Figure 26:
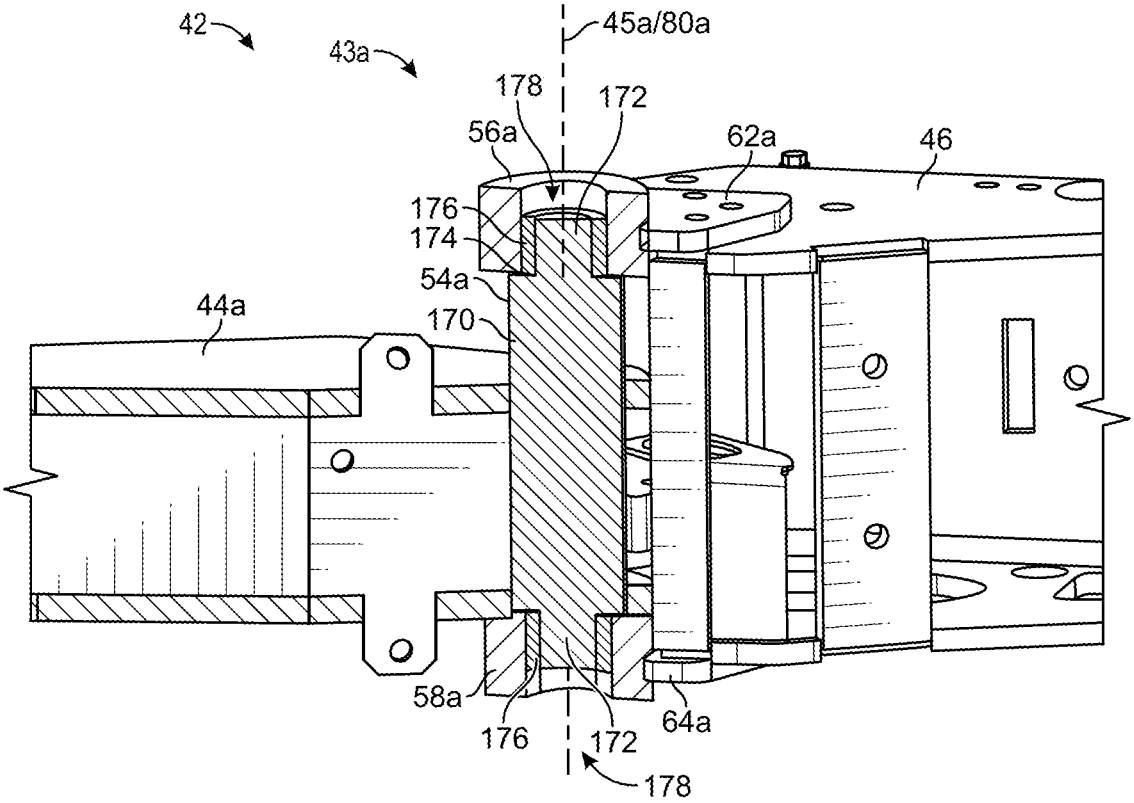
FIG. 26 is a perspective cross-sectional view of the adapter assembly of FIG. 1, according to an exemplary embodiment.

Referring now to FIG. 26, first adapter assembly 43*a* of grabber assembly 42 is shown in detail, according to another embodiment. As shown in FIG. 26, first grabber arm connector 54*a* is a stepped cylindrical member. First grabber arm connector 54*a* is shown configured as a solid member, however, first grabber arm connector 54*a* may also include inner volumes or spaces to facilitate weight reduction of grabber arm 44*a*.

First grabber arm connector 54*a* includes a central portion 170, and end portions 172. Central portion 170 and end portions 172 can be cylindrical members having a circular outer periphery. In some embodiments, central portion 170 has a cross-sectional shape that is square, rectangular, irregularly shaped, etc., while end portions 172 have a circular cross-sectional shape. Central portion 170 and end portions 172 have different outer diameters, areas, outer radii, etc., and define a step or a shoulder 174 at the transition therebetween. For example, central portion 170 may have an outer diameter that is greater than an outer diameter of end portions 172.

First adapter assembly 43*a* includes a sleeve bushing, a sleeve member, a bearing, a slidable bearing, etc., shown as sleeve 176. Sleeve 176 is positioned within a central aperture, a central inner volume, a through hole, a space, etc., of top adapter piece 56*a*, shown as central bore 178. Central bore 178 extends substantially through an entire longitudinal thickness of top adapter piece 56*a* and may have a circular cross-sectional shape.

Sleeve 176 can be press fit or slip fit into central bore 178 and may either slidably or fixedly couple with top adapter piece 56*a*. Sleeve 176 has the shape of a hollow cylindrical member and receives end portion 172 therewithin. A radially outwards facing surface of end portion 172 slidably couples with a radially inwards facing surface of sleeve 176 so that first grabber arm connector 54*a* can rotate relative to sleeve 176. In other embodiments sleeve 176 is press fit or otherwise fixedly coupled with end portion 172 so that sleeve 176 and end portion 172 rotate in unison. If sleeve 176 is fixedly coupled with end portion 172, sleeve 176 may be slip fit or rotatably/pivotally coupled with the radially inwards facing surface of top adapter piece 56*a* so that sleeve 176 and first grabber arm connector 54*a* can rotate in unison relative to top adapter piece 56*a*. Shoulder 174 of first grabber arm connector 54*a* is configured to engage a corresponding portion, shoulder, step, corner, etc., of sleeve 176. In some embodiments, shoulder 174 of first grabber arm connector 54*a* is slidably coupled with the corresponding shoulder of sleeve 176.

In some embodiments, sleeve 176 is manufactured from or includes a polymeric wear resistant material similar to the polymeric wear resistant materials listen above with reference to FIG. 7. In this way, sleeve 176 may facilitate a greaseless interface between top and bottom adapter pieces 56*a* and 58*a* and grabber arm 44*a*. It should be understood that first grabber arm connector 54*a* may pivotally or rotatably couple with bottom adapter piece 58*a* using a same or similar construction, configuration, components (e.g., sleeve 176), etc., as used to rotatably couple first grabber arm connector 54*a* with top adapter piece 56*a*. Additionally, while FIG. 26 shows only first adapter assembly 43*a*, second adapter assembly 43*b* may be similarly and/or symmetrically configured and constructed.

Grabber Drive System

Figure 18:
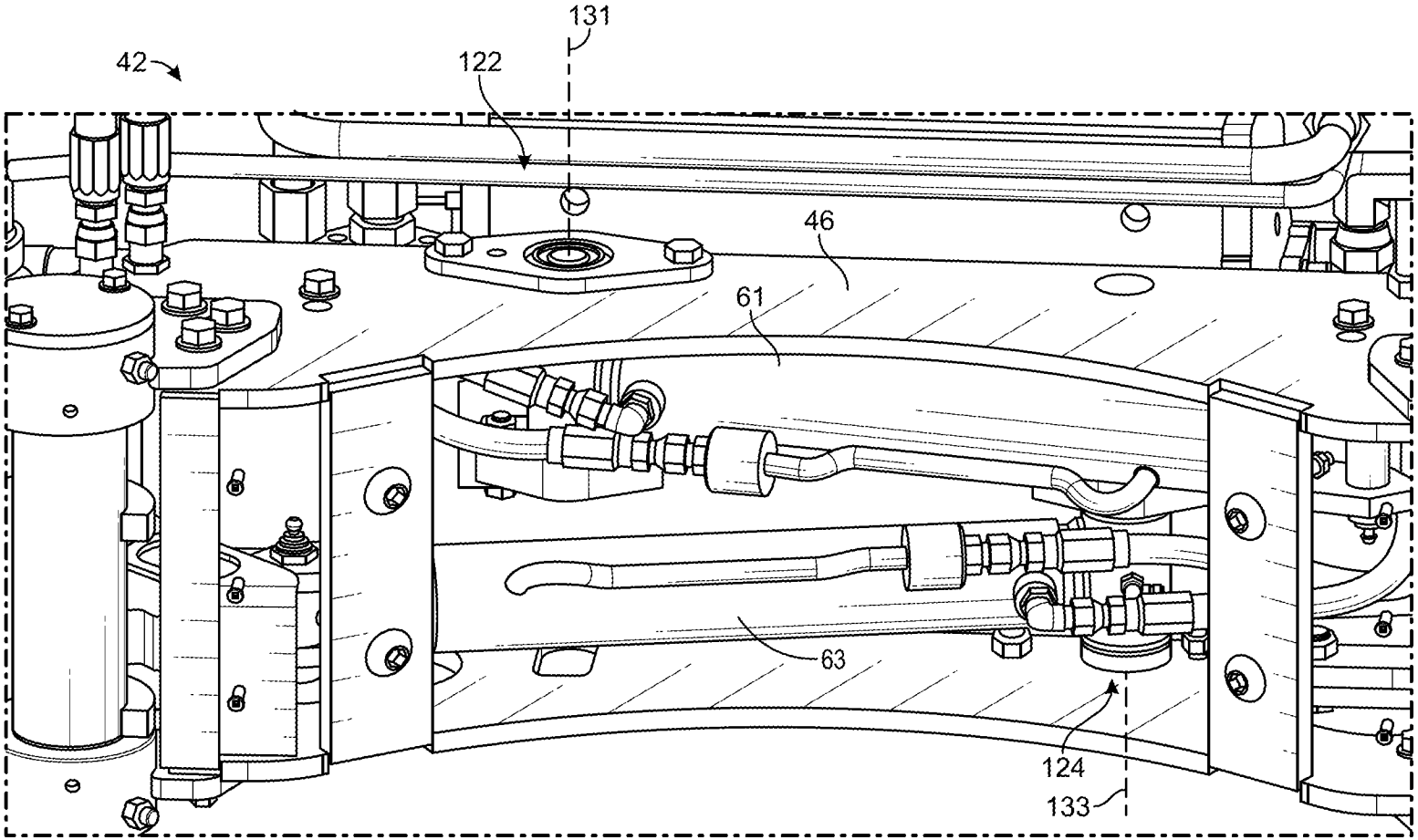
FIG. 18 is a perspective view of double-action cylinders of the grabber assembly of FIG. 1, according to an exemplary embodiment.

Referring now to FIG. 18, double-action cylinder 61 and double-action cylinder 63 are shown removably coupled with carriage 46, according to an exemplary embodiment. In some embodiments, double-action cylinder 61 is configured to drive grabber arm 44*b* (not shown) to pivot to grasp a refuse container. In some embodiments, double-action cylinder 63 is configured to drive grabber arm 44*a* (not shown) to pivot to grasp the refuse container. Double-action cylinder 61 is shown removably coupled with carriage 46 through removable connection 122. Double-action cylinder 63 is shown removably coupled with carriage 46 through removable connection 124. In some embodiments, double-action cylinder 61 and double-action cylinder 63 are similarly constructed, so that whatever is said of double-action cylinder 61 may be said of double-action cylinder 63 and vice versa. In some embodiments, removable connection 122 is similar to removable connection 124 such that whatever is said of removable connection 122 may be said of removable connection 124 and vice versa. Removable connection 122 and removable connection 124 may be configured to allow double-action cylinder 61 and double-action cylinder 63 to pivot about axis 131 and axis 133, respectively. In some embodiments, as double-action cylinder 61 and double-action cylinder 63 extend or retract (to cause grabber arms 44 to rotate to grasp the refuse container), double-action cylinder 61 and double-action cylinder 63 pivot about axis 131 and axis 133, respectively.

Figure 19:
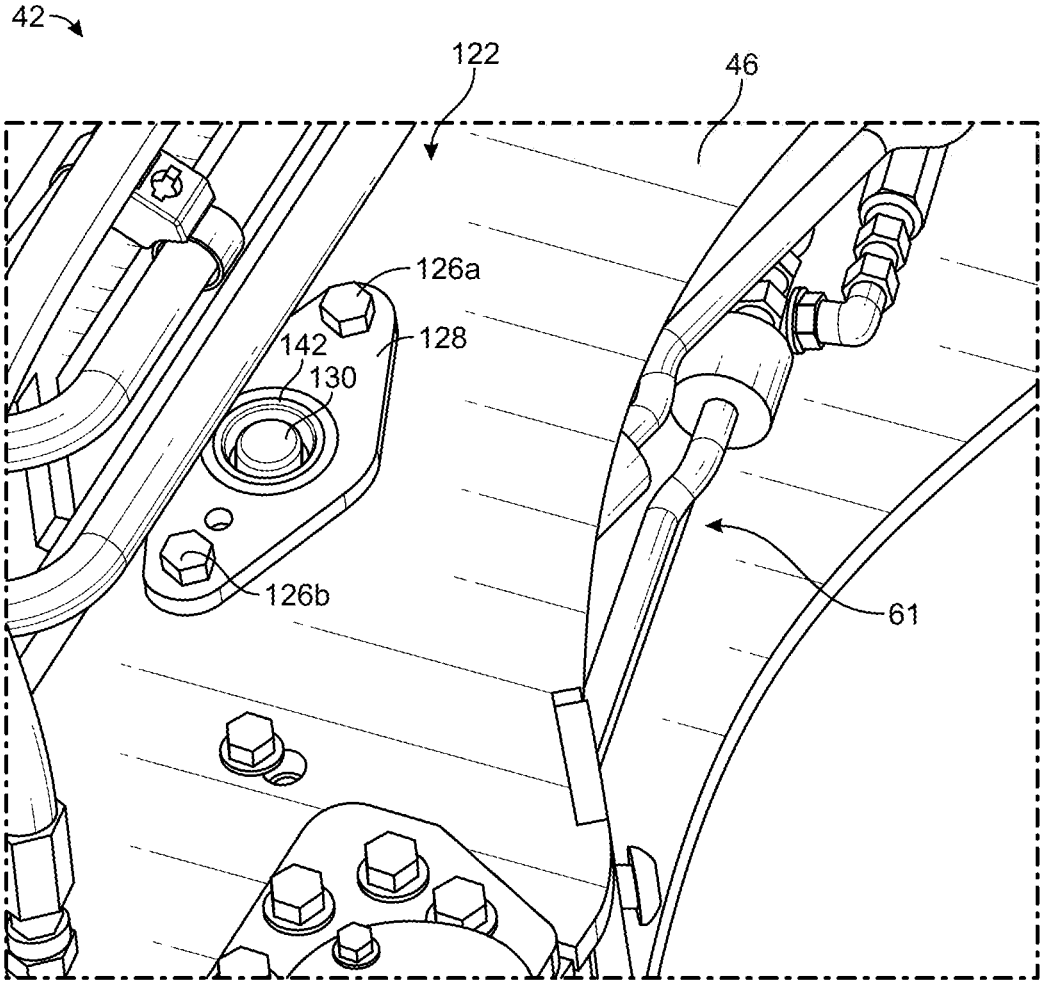
FIG. 19 is a top view of a removable connection of the double-action cylinders of the grabber assembly of FIG. 1, according to an exemplary embodiment.
Figure 20:
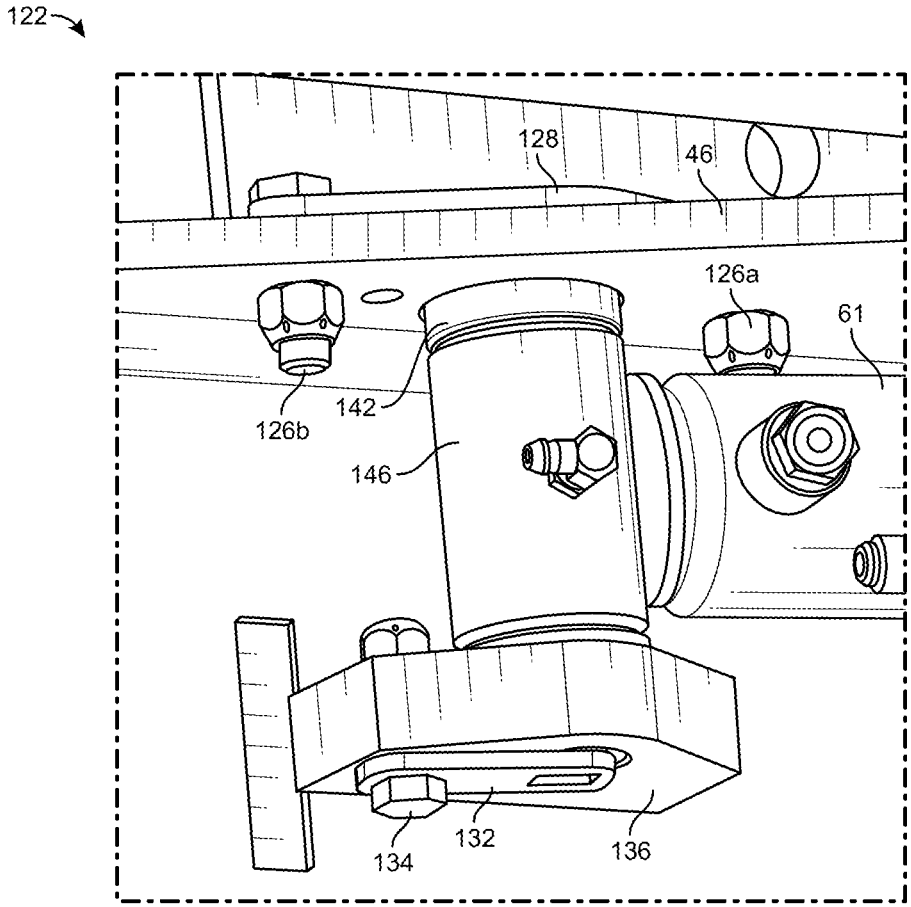
FIG. 20 is a perspective view of the removable connection of the double-action cylinders of the grabber assembly of FIG. 1, according to an exemplary embodiment.

Referring now to FIGS. 19-20 removable connection 122 of double-action cylinder 61 is shown in greater detail, according to some embodiments. Removable connection 122 is shown to include a plate, shown as fastener plate 128, according to an exemplary embodiment. Fastener plate 128 may be configured to removably couple with carriage 46 via removable fasteners, shown as removable fastener 126*a* and removable fastener 126*b* (e.g., bolts). In some embodiments, fastener plate 128 is configured to interface with a bushing, shown as bushing 142. Bushing 142 may be configured to slidably interface or fixedly interface with a pin, shown as connector pin 130, according to some embodiments. In some embodiments, connector pin 130 extends through an entire height of a connecting portion of double-action cylinder 61, shown as connecting portion 146. Connecting portion 146 may be integrally formed with a body of double-action cylinder 61, according to some embodiments. In some embodiments, connecting portion 146 includes an aperture which extends through an entire height of connecting portion 146 and is configured to allow connector pin 130 to extend through the aperture. In some embodiments, connecting portion 146 is configured to rotate relative to connector pin 130. In some embodiments, both connecting portion 146 and connector pin 130 are configured to rotate relative to bushing 142.

Figure 21:
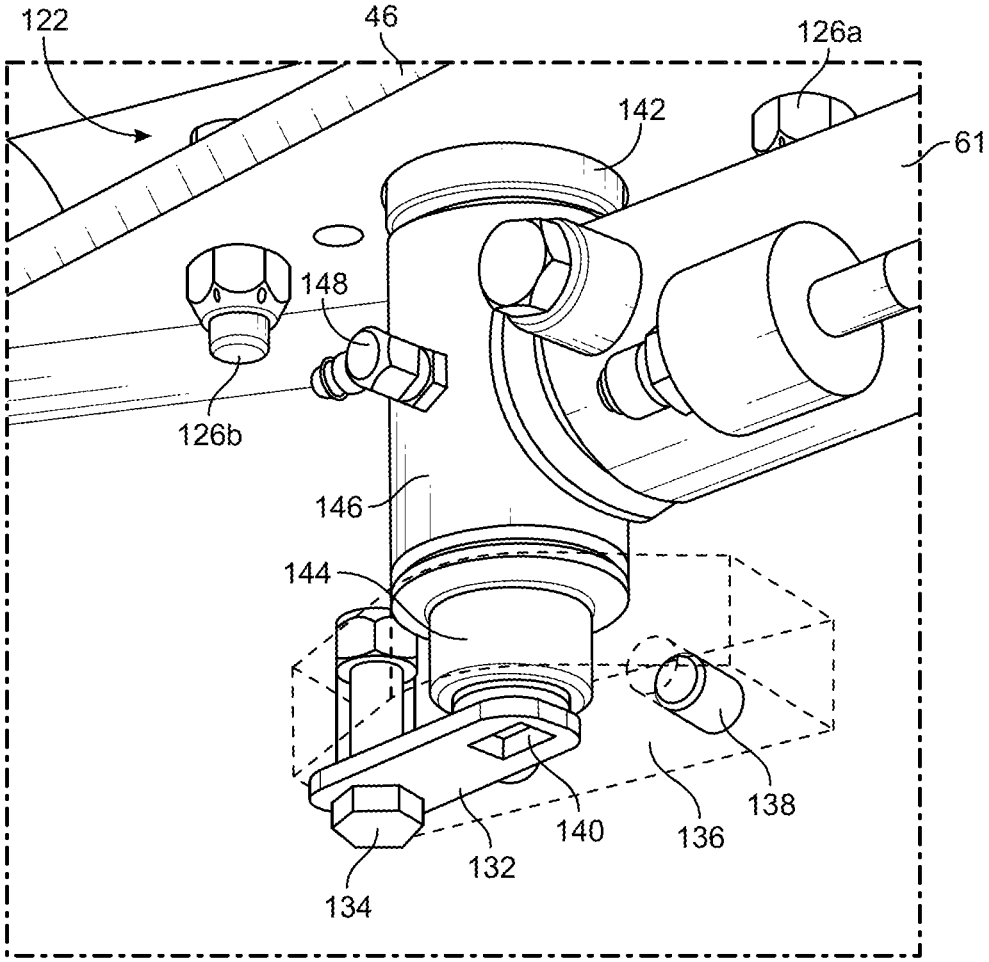
FIG. 21 is a perspective view of the removable connection of the double-action cylinders of the grabber assembly of FIG. 1, according to an exemplary embodiment.

Referring now to FIGS. 20-21, removable connection 122 is shown to include a bottom connecting feature, shown as connecting feature 136, according to an exemplary embodiment. Connecting feature 136 is shown configured to support a bottom end of connector pin 130, according to some embodiments. Connecting feature 136 is shown to include a connecting member, shown as connecting member 132. Connecting member 132 may include a protrusion, shown as protrusion 140 which extends into the bottom end of connector pin 130, according to some embodiments. In some embodiments, protrusion 140 is configured to prevent connector pin 130 from rotating. In some embodiments, connecting member 132 does not include protrusion 140 and is configured to support connector pin 130, while allowing connector pin 130 to rotate relative to connecting member 132. Connecting member 132 is shown removably coupled with connecting feature 136 via a fastener, shown as removable fastener 134, according to an exemplary embodiment. Connecting member 132 is shown removably coupled with carriage 46 via a fastener, shown as removable fastener 138, according to some embodiments. In some embodiments, connecting feature 136 includes an aperture extending through an entire height of connecting feature 136 and configured to receive the bottom end of connector pin 130. In some embodiments, a bushing, shown as bushing 144, is disposed within the aperture of connecting feature 136 and is configured to receive the bottom end of connector pin 130. In some embodiments, connector pin 130 is configured to slidably interface with bushing 144, allowing connector pin to rotate within bushing 144. In some embodiments, connector pin 130 is configured to fixedly interface with bushing 144, resulting in connector pin 130 and bushing 144 rotating in unison.

Figure 22:
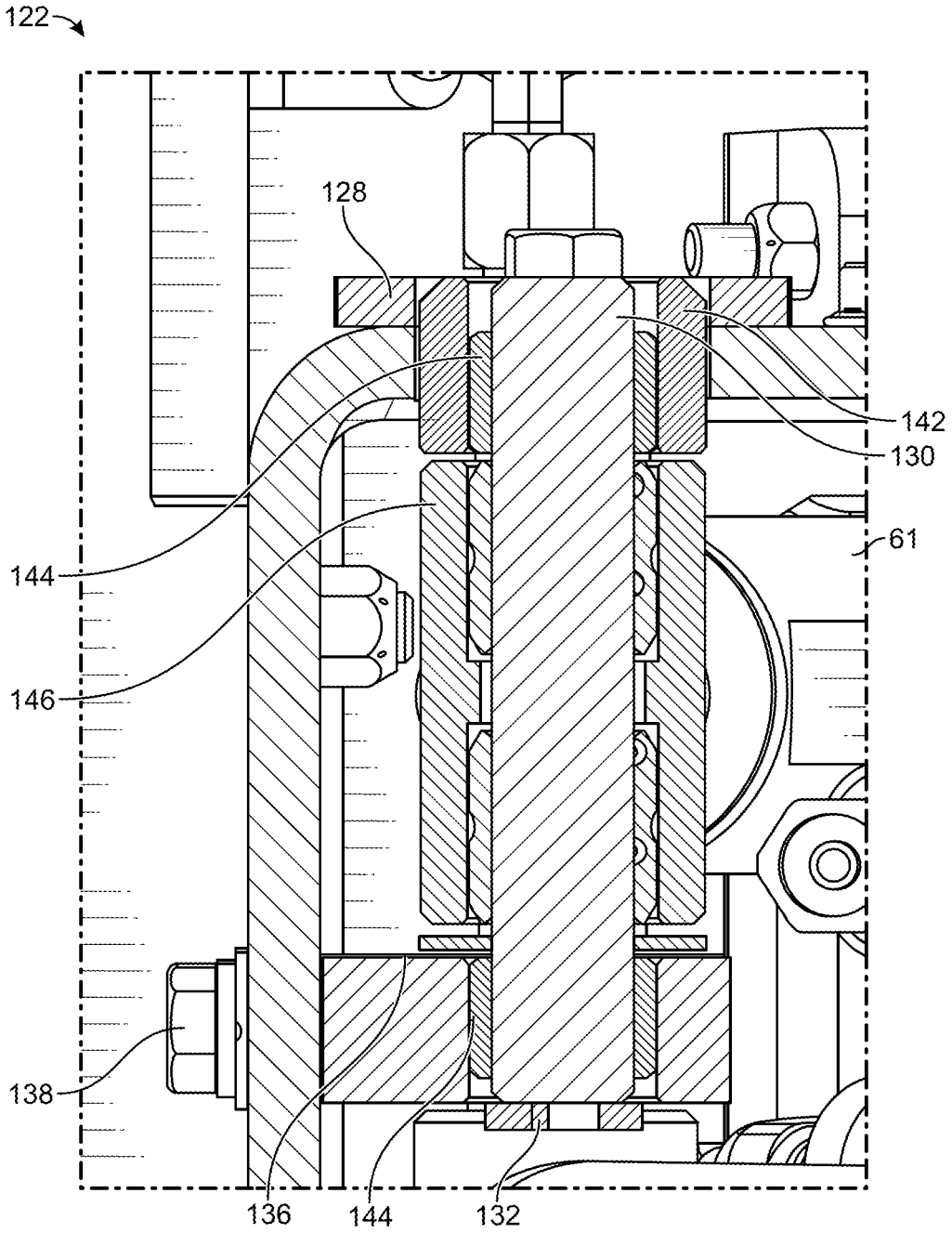
FIG. 22 is a sectional view of the removable connection of the double-action cylinders of the grabber assembly of FIG. 1, according to an exemplary embodiment.

Referring now to FIG. 22, a sectional view of removable connection 122 is shown, according to an exemplary embodiment. Removable connection 122 is shown to include a bushing, shown as bushing 144 near the top end of connector pin 130, according to an exemplary embodiment. Connector pin 130 is shown extending through an aperture of connecting portion 146 of double-action cylinder 61, according to an exemplary embodiment. Connector pin 130 is also shown extending through upper bushing 144 and lower bushing144, positioned at opposite ends of connector pin 130. Connector pin 130 may slidably interface with an inner diameter of connecting portion 146 of double-action cylinder 61, according to some embodiments. The slidable interface between connector pin 130 and inner diameter of connecting portion 146 may be provided with lubrication through a lubrication delivery system, shown as grease fitting 148 (see FIG. 21), according to an exemplary embodiment.

In an exemplary embodiment, removable connection 124 is constructed and configured similarly to removable connection 122. Both removable connection 122 and removable connection 124 may allow double-action cylinder 61 and double-action cylinder 63 to be removably disconnected from carriage 46 for maintenance purposes. This removable connection decreases service time, and improves maintenance efficiency.

Double-action cylinder 63 and double-action cylinder 61 may be configured to drive first grabber arm 44*a* and second grabber arm 44*b*, respectively, to grasp a refuse container. In some embodiments, each of double-action cylinder 63 and double-action cylinder 61 are disposed within carriage 46. Double-action cylinder 63 and double-action cylinder 61 may be removably coupled with carriage 46 as described in greater detail above with reference to FIGS. 18-22. In some embodiments, double-action cylinder 63 and double-action cylinder 61 are each configured to attach at an opposite end to first grabber arm 44*a* and second grabber arm 44b, respectively, in the same removable manner as described in greater detail above with reference to FIGS. 18-22. In some embodiments, each of double-action cylinder 63 and double-action cylinder 61 couple with first grabber arm 44*a* and second grabber arm 44*b* at a rear face of first grabber arm 44*a* or second grabber arm 44*b*.

Process for Servicing a Grabber Assembly

Figure 10:
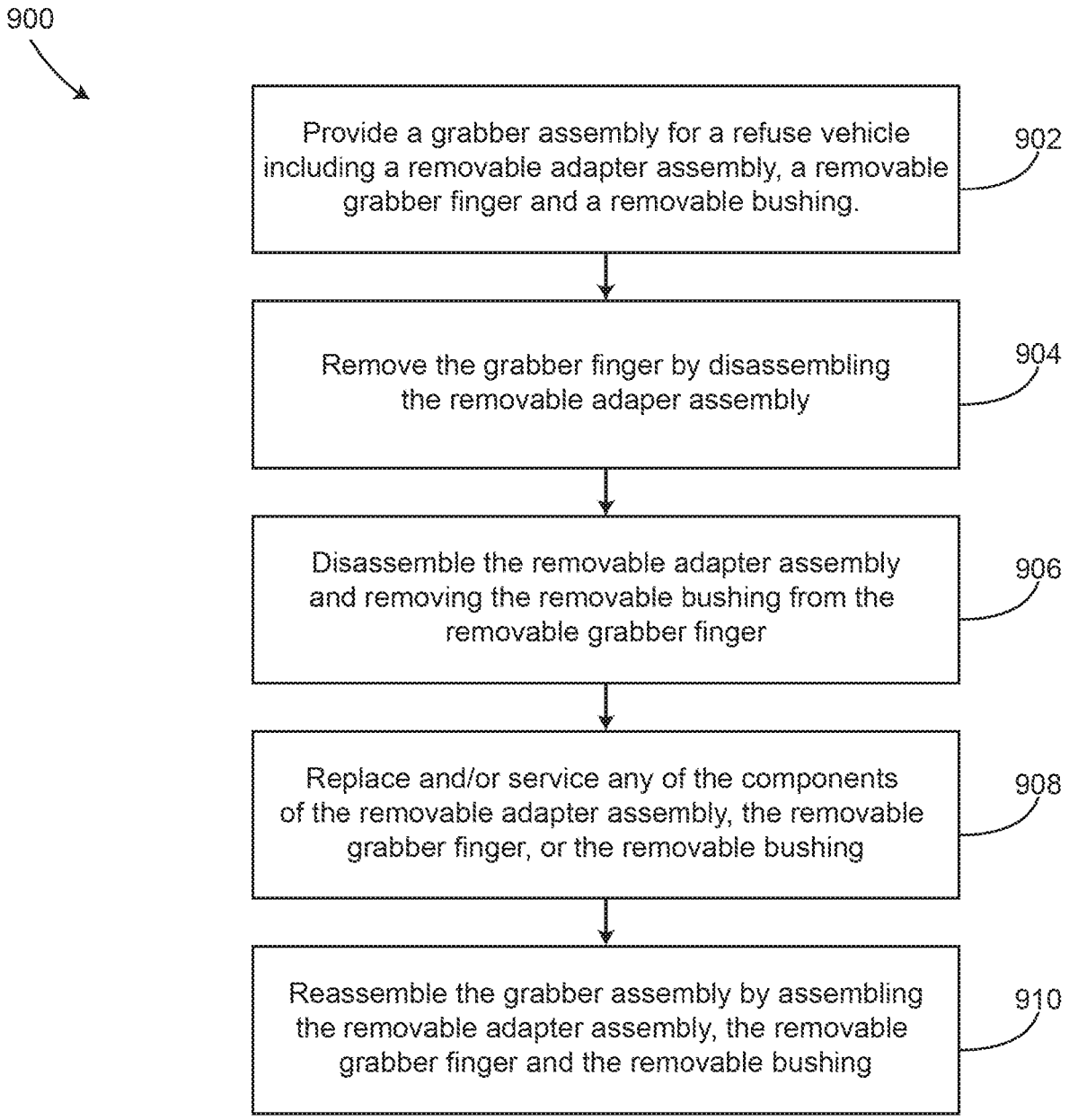
FIG. 10 is a method for servicing the grabber assembly of FIG. 1, according to an exemplary embodiment.
Figure 11:
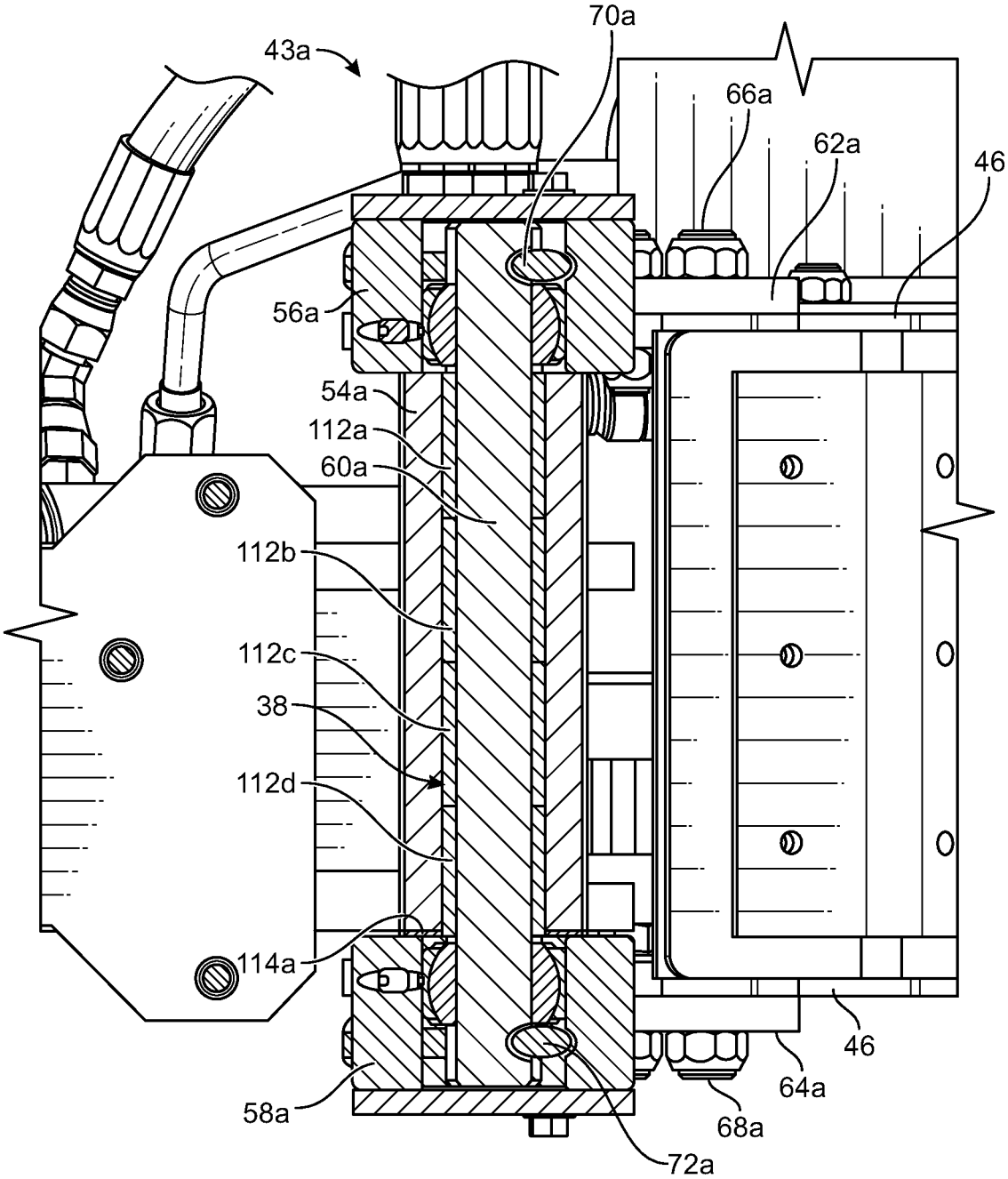
FIG. 11 is a sectional view of an adapter assembly of the grabber assembly of FIG. 1, according to an exemplary embodiment.

Referring now to FIG. 10, a process 900 for servicing/replacing any components of grabber assembly 42 is shown. Process 900 includes steps 902-910, according to some embodiments. Process 900 can be performed by a technician, an operator, maintenance personnel, a fleet manager, etc.

Process 900 includes providing a grabber assembly for a refuse vehicle that has a removable adapter assembly, a removable grabber finger, and a removable bushing (step 902), according to some embodiments. The grabber assembly may be grabber assembly 42, the adapter assembly may be any of adapter assembly 43*a* and/or adapter assembly 43*b*, the removable grabber finger may be either of first grabber arm 44*a* and/or second grabber arm 44*b*, and the removable bushing may be first grabber arm connector 54*a* and/or second grabber arm connector 54*b*.

Process 900 includes removing the grabber finger (e.g., first grabber arm 44*a* and/or second grabber arm 44b) by disassembling the removable adapter assembly (e.g., adapter assembly 43*a* and/or adapter assembly 43*b*) (step 904), according to some embodiments. Step 904 can be performed by a technician by disassembling or de-coupling at least one of the first adapter assembly 43*a* and the second adapter assembly 43*b* from carriage 46. Step 904 may be accomplished by disconnecting or de-coupling at least one of fasteners 66*a* and fasteners 68*a* of first adapter assembly 43*a*, or fasteners 66*b* and fasteners 68*b* of second adapter assembly 43*b*.

Process 900 includes disassembling the removable adapter assembly and removing (or disassembling) the removable bushing from the removable grabber finger (step 906), according to some embodiments. In some embodiments, step 906 is performed by disassembling or removing at least one of the first adapter assembly 43*a* and the second adapter assembly 43*b*. Step 906 may be accomplished by removing at least one of the top pin fastener 70*a* and bottom pin fastener 72*a*, or the top pin fastener 70*b* and the bottom pin fastener 72*a* to disassemble at least one of the first adapter assembly 43*a* and the second adapter assembly 43*b*.

Process 900 includes replacing and/or servicing any of the components of the removable adapter assembly, the removable grabber finger, or the removable bushing (step 908), according to some embodiments. In some embodiments, step 908 includes replacing any of the components of grabber assembly 42. Step 908 may be performed by a technician by replacing any of top adapter piece 56*a*, top adapter piece 56*b*, bottom adapter piece 58*a*, bottom adapter piece 58*b*, adapter assembly pin 60*a*, adapter assembly pin 60*b*, first grabber arm connector 54*a*, second grabber arm connector 54*b*, first grabber arm 44*a*, second grabber arm 44*b*, a polymeric wear sleeve, etc., or any other component of grabber assembly 42.

Process 900 includes re-assembling the grabber assembly by assembling the removable adapter assembly, the removable grabber finger, and the removable bushing (step 910), according to some embodiments. Step 910 may include reassembling grabber assembly 42. Step 910 may be performed by a technician by performing steps 902-908 (or steps 902-906) in reverse As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A grabber assembly comprising:
a carriage;
an adapter assembly coupled to the carriage, the adapter assembly comprising:
a pin;
a first member configured to receive a first end of the pin and removably fixedly couple with the first end of the pin;
a second member configured to receive a second end of the pin and removably fixedly couple with the second end of the pin;
a sleeve extending co-cylindrically with the pin; and
a grabber arm comprising:
a bushing fixedly coupled with the grabber arm, wherein the bushing is pivotally coupled to the pin;
wherein the sleeve is positioned within a central bore of the bushing, between the bushing and the pin.

2. The grabber assembly of claim 1, wherein the sleeve is manufactured from or include a polymeric material.

3. The grabber assembly of claim 1, wherein the first end of the pin is removably coupled with the first member with a first coupler and the second end of the pin is removably coupled with the second member with a second coupler.

4. The grabber assembly of claim 1, wherein the first member is fixedly coupled with a first attachment member and the second member is fixedly coupled with a second attachment member, wherein the first attachment member and the second attachment member are planar members configured to removably couple with a corresponding portion of the carriage.

5. The grabber assembly of claim 1, further comprising another of the adapter assembly and another of the grabber arm, wherein the adapter assembly and the grabber arm are positioned at a first end of the carriage and the other adapter assembly and the other grabber arm are positioned at a second end of the carriage.

6. The grabber assembly of claim 1, wherein the bushing, the pin, the first member, the second member, and the sleeve are co-axial.

7. The grabber assembly of claim 1, wherein at least one of:
the grabber arm and the bushing are configured to rotate or pivot relative to the sleeve and the pin; or
the grabber arm, the bushing, and the sleeve are configured to rotate or pivot relative to the pin.

8. A grabber assembly comprising:
a carriage;
an adapter assembly coupled to the carriage, the adapter assembly comprising:
a sleeve;
a pin extending through the sleeve, the pin comprising a longitudinal passageway and one or more radially extending passageways that fluidly couple with the longitudinal passageway and a gap defined between a radially inwards facing surface of the sleeve and a radially outwards facing surface of the pin;
a first member configured to receive a first end of the pin and pivotally couple with the first end of the pin;
a second member configured to receive a second end of the pin and pivotally couple with the second end of the pin; and
a grabber arm comprising:
a bushing fixedly coupled with the grabber arm, wherein the bushing is configured to pivotally couple with the pin.

9. The grabber assembly of claim 8, wherein the first end and the second end of the pin each include a step, wherein the step is defined between a central portion of the pin and end portions of the pin.

10. The grabber assembly of claim 9, wherein the step of the first end and the second end of the pin is configured to engage or abut a correspondingly shaped step of the first member or the second member.

11. The grabber assembly of claim 8, wherein the radially outwards facing surface of the pin slidably couples with the radially inwards facing surface of the sleeve.

12. The grabber assembly of claim 8, wherein the pin comprises a grease fitting fluidly coupled with the longitudinal passageway at an inlet of the longitudinal passageway.

13. The grabber assembly of claim 8, wherein the first end of the pin is received within a stepped inner volume of the first member and the second end of the pin is received within a stepped inner volume of the second member.

14. The grabber assembly of claim 8, wherein the first member is fixedly coupled with a first attachment member, and the second member is fixedly coupled with a second attachment member, wherein the first attachment member and the second attachment member are planar members configured to removably and fixedly couple with the carriage.

15. A grabber assembly comprising:
a carriage;
a grabber arm pivotally coupled with the carriage;
a double-action cylinder configured to extend and retract to pivot the grabber arm relative to the carriage, wherein the double-action cylinder is configured to pivotally couple with the grabber arm at a first end of the double-action cylinder and pivotally couple with the carriage at a second end of the double-action cylinder through a mount assembly, the mount assembly comprising:
a first mounting member and a second mounting member fixedly and removably coupled with the carriage;
a cylindrical member extending between the first mounting member and the second mounting member, wherein the cylindrical member extends through a corresponding aperture of the second end of the double-action cylinder;
a first bushing positioned within a bore of the first mounting member; and
a second bushing positioned within a bore of the second mounting member;
wherein the cylindrical member extends through a central aperture of the first bushing and the second bushing;
wherein the cylindrical member is fixedly coupled with at least one of the first mounting member and the second mounting member through a connection member.

16. The grabber assembly of claim 15, wherein the first mounting member and the second mounting member are fixedly and removably coupled with portions of the carriage that are substantially perpendicular to each other.

17. The grabber assembly of claim 15, wherein the connection member is an elongated member comprising:
a first end; and
a second end comprising a protrusion;
wherein the first end of the connection member is fixedly coupled with the second attachment member and the protrusion of the second end is configured to interlock with a correspondingly shaped recess formed in an end of the cylindrical member.

18. The grabber assembly of claim 15, wherein the mount assembly further comprises an outer bushing, wherein the first bushing is positioned within the outer bushing and the outer bushing extends through an aperture of the carriage and an aperture of the first mounting member.

19. The grabber assembly of claim 18, wherein the outer bushing, the first bushing, and the cylindrical member are co-cylindrical with each other.

20. The grabber assembly of claim 15, wherein the double-action cylinder further comprises a lubricant fitting, wherein the lubricant fitting is configured to fluidly couple with a space defined between a radially inwards facing surface of the second end of the double-action cylinder and a radially outwards facing surface of the cylindrical member.

* * * * *